US010384748B2

(12) United States Patent
McDonough et al.

(10) Patent No.: US 10,384,748 B2
(45) Date of Patent: Aug. 20, 2019

(54) STORAGE COMPARTMENT FOR A PERSONAL WATERCRAFT

(71) Applicants: Robert J. McDonough, Bangor, ME (US); Timothy A. Bragg, Winterport, ME (US)

(72) Inventors: Robert J. McDonough, Bangor, ME (US); Timothy A. Bragg, Winterport, ME (US)

(73) Assignee: Johnson Outdoors Inc., Racine, WI (US)

( * ) Notice: Subject to any disclaimer, the term of this patent is extended or adjusted under 35 U.S.C. 154(b) by 81 days.

(21) Appl. No.: 15/331,616

(22) Filed: Oct. 21, 2016

(65) Prior Publication Data

US 2017/0113763 A1 Apr. 27, 2017

Related U.S. Application Data

(60) Provisional application No. 62/245,110, filed on Oct. 22, 2015.

(51) Int. Cl.

| | |
|---|---|
| ***B63B 35/71*** | (2006.01) |
| ***B63B 25/00*** | (2006.01) |
| *B63B 19/14* | (2006.01) |

(52) U.S. Cl.

CPC ..... *B63B 35/71* (2013.01); *B63B 25/002* (2013.01); *B63B 19/14* (2013.01); *B63B 2035/715* (2013.01)

(58) Field of Classification Search

CPC ..... B63B 19/12; B63B 25/00; B63B 35/71; B63B 2035/715; B63B 19/14; B63B 19/19; B63B 19/197; B63B 19/203; B63B 19/24; B63B 2019/245; B63B 19/26; B65D 81/3816; B60R 2011/0007

See application file for complete search history.

(56) References Cited

U.S. PATENT DOCUMENTS

| | | | | |
|---|---|---|---|---|
| 4,871,079 | A * | 10/1989 | Doucette | A01K 97/04 220/560 |
| 5,863,089 | A * | 1/1999 | Ignarra | B60N 3/102 224/926 |
| 6,761,388 | B2 * | 7/2004 | Lein | B60N 3/002 296/24.34 |
| 7,748,762 | B2 * | 7/2010 | Mayne, Jr. | B60R 7/04 296/24.34 |
| 9,674,975 | B2 * | 6/2017 | Carnevali | H05K 5/03 |
| 2011/0226785 | A1 * | 9/2011 | Sakell | A01K 97/20 220/592.2 |
| 2015/0059637 | A1 * | 3/2015 | Johns | B63B 35/71 114/363 |
| 2018/0141718 | A1 * | 5/2018 | Ahlstrom | A45F 3/46 |

OTHER PUBLICATIONS

Definition of "membrane", Oxford English Dictionary, retrieved Feb. 5, 2019 (Year: 2019).*

* cited by examiner

*Primary Examiner* — Andrew Polay

(74) *Attorney, Agent, or Firm* — Reinhart Boerner Van Deuren P.C.

(57) ABSTRACT

A cover adapted to be reversibly attached over an opening of a storage compartment contained on a personal watercraft. The cover includes a generally planar substrate having formed therein a dry storage chamber and at least one additional feature selected from the group consisting of a cup holder, an equipment rail, a surround tray, an accessory mounting plate, and a magnetic surface.

10 Claims, 29 Drawing Sheets

STORAGE COMPARTMENT FOR A PERSONAL WATERCRAFT

CROSS-REFERENCE TO RELATED PATENT APPLICATION

This patent application claims the benefit of U.S. Provisional Patent Application No. 62/245,110, filed Oct. 22, 2015, the entire teachings and disclosure of which are incorporated herein by reference thereto.

FIELD OF THE INVENTION

This invention generally relates generally to personal watercraft and more particularly to storage devices or storage compartments for personal watercraft.

BACKGROUND OF THE INVENTION

Personal watercraft, such as kayaks are used by people, such as sportsmen, to explore, fish, or travel along rivers, across lakes, or over other bodies of water. Frequently, a person using personal watercraft will also carry gear, such as cellular phones, maps, fishing equipment, flashlights, matches, and other personal or sporting items. Convenient and safe storage for these items on a personal watercraft is often problematic given the small confines typically associated with such watercraft.

BRIEF SUMMARY OF THE INVENTION

In one aspect, a cover adapted to be reversibly attached over an opening of a storage compartment contained on a personal watercraft is provided. The cover includes a generally planar substrate having formed therein a dry storage chamber, and at least one additional feature selected from the group consisting of a cup holder, an equipment rail, a fishing rod holder, a surround tray, an accessory mounting plate, and a magnetic surface.

In embodiments of the cover, the dry storage chamber is a cellular device compartment. In such embodiments, the cellular device compartment has a clear lid such that the contents of the cellular device compartment can be seen through the clear lid. In other such embodiments, the cellular device compartment includes at least one rib configured to keep a device off of the floor of the cellular device compartment.

In a specific embodiment of the cover, the cover includes the additional features of a surround tray, a cup holder, an equipment rail, and two fishing rod holders. In another specific embodiment of the cover, the cover includes the additional features of a surround tray, an accessory plate, a cup holder, two equipment rails, and a fishing rod holder. In still another specific embodiment of the cover, a cellular device compartment is provided on top of the dry storage chamber, and the cellular device compartment includes a frame that defines a space between a lid of the dry storage chamber and the frame.

In embodiments of the cover, the cover is adapted to rotate about a hinge along a longitudinal edge of the opening. In other embodiments of the cover, the cover is divided into a first end and a second end by a center hinge, and the center hinge is preferably perpendicular to the longitudinal axis of the cover. In this embodiment, the center hinge can be adapted to provide rotation of the first and second ends from a first position in which the first and second ends are generally planar to a second position in which the angle between the top surfaces of the first and second ends is less than 180°. Alternatively, in this embodiment, the second end of the cover can be hinged to an end of the opening. The center hinge can be adapted to provide rotation of the first and second ends from a first position in which the first and second ends are generally planar to a second position in which the angle between the bottom surfaces of the first and second ends is less than 180°.

In another aspect, a storage compartment in a personal watercraft is provided. The storage compartment includes an opening in a deck of the personal watercraft. The opening provides a passage to an air volume defined by the deck and a hull of the personal watercraft. The storage compartment also includes a cover that selectively engages the opening, and the cover includes a dry storage chamber formed into the cover. The storage compartment further includes at least one removable tray that occupies at least a portion of the opening.

In embodiments of the storage compartment, the cover is attached to the personal watercraft using at least one hinge on a side of the opening. In other embodiments, the cover is attached to the personal watercraft using at least one latch on at least one side of the opening. In still other embodiments, the cover is divided into a first end and a second end by a center hinge. In such embodiments, the second end of the cover is attached to the personal watercraft using an end hinge.

In embodiments of the storage compartment, the cover can include at least one additional feature selected from the group consisting of a cup holder, an equipment rail, a fishing rod holder mount, a surround tray, an accessory mounting plate, and a magnetic surface.

In a third aspect, a storage compartment for a personal watercraft is provided in which an opening is provided in a console member of a pedal drive system. The console member has an interior air cavity to which the opening provides access, and a cover is adapted to reversibly engage the opening.

In embodiments, the cover engages the opening in such a way as to prevent water from entering the storage compartment. In other embodiments, the cover is connected to the console member via a hinge such that the storage compartment is opened and closed via rotation of the cover about the hinge.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Various embodiments of a storage compartment for a personal watercraft are provided herein. In a particular embodiment, the storage compartment is located in the deck of the personal watercraft. The storage compartments discussed herein can be used in any of a variety of personal watercraft; however, by way of example, the various embodiments of the storage compartment will be described in relation to a kayak.

Figure 1A:
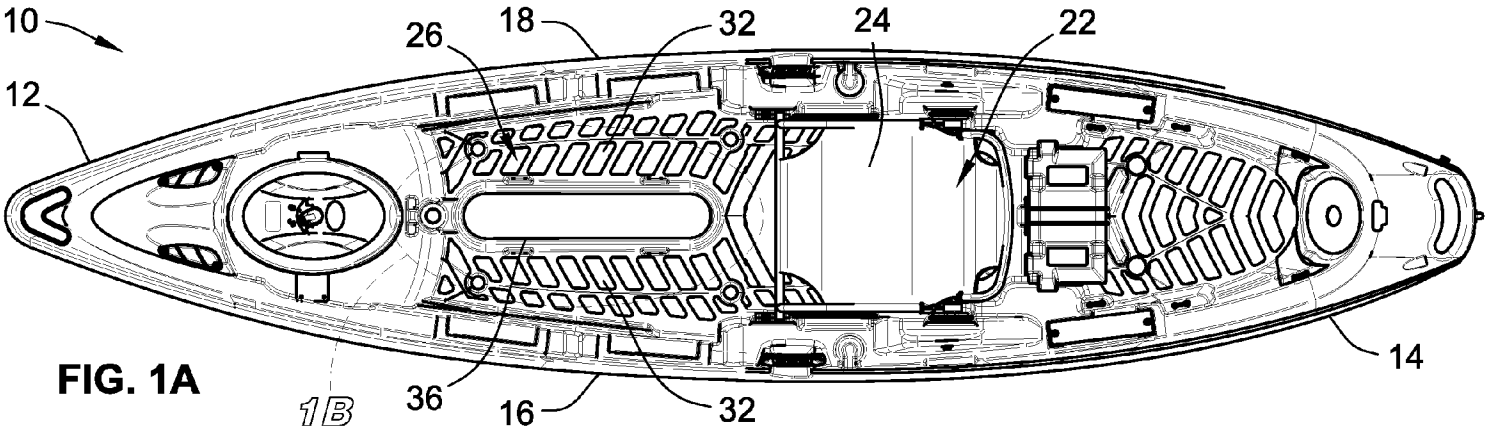
FIGS. 1A-B depict an opening of a personal watercraft according to an exemplary embodiment.
Figure 1B:
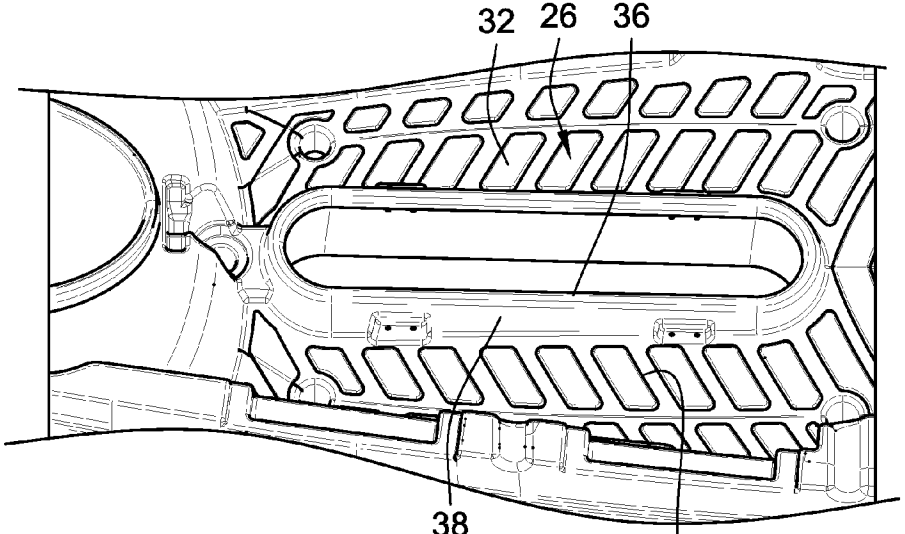
Figure 1C:
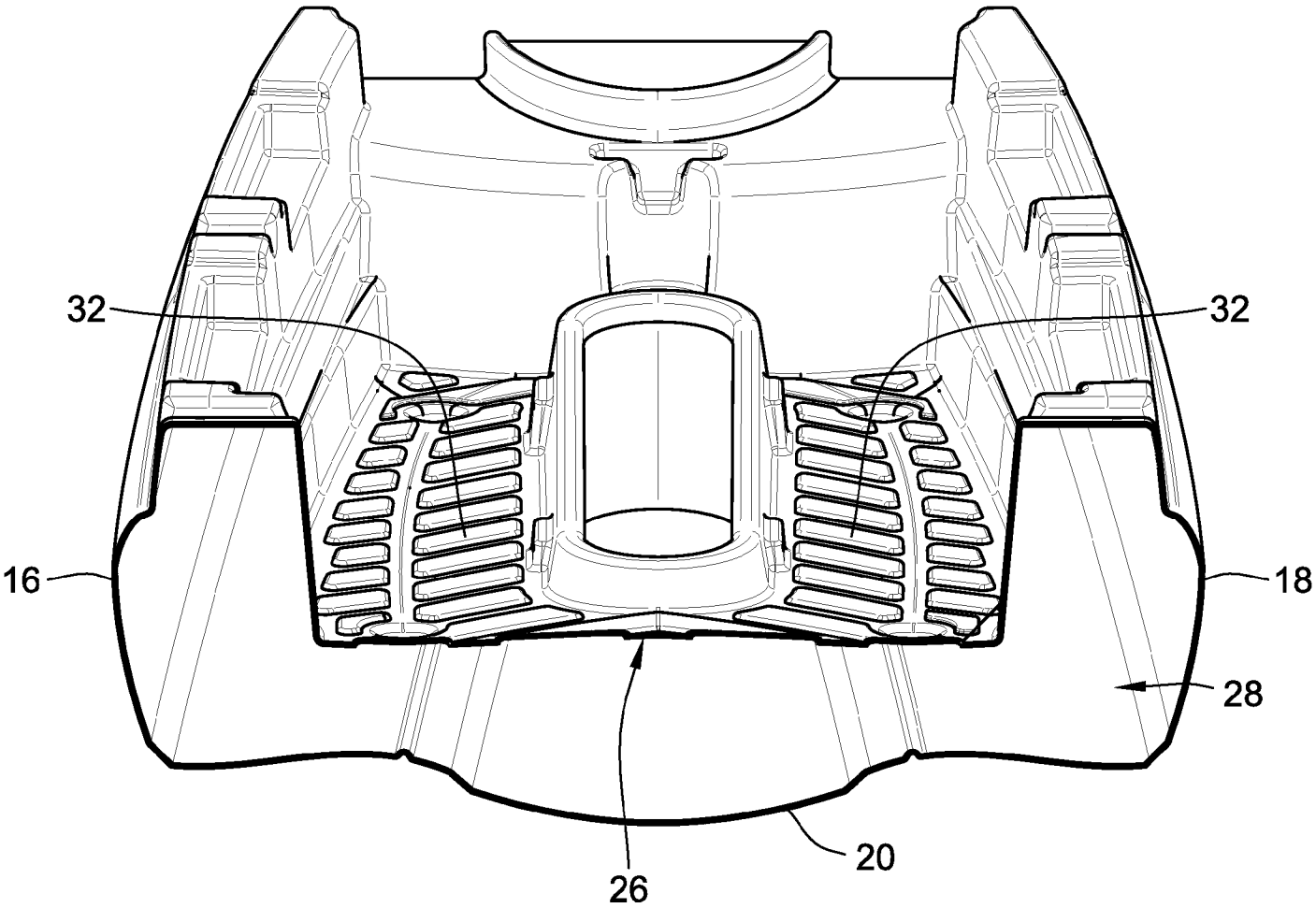
FIG. 1C is a sectional view of the personal water craft depicted in FIG. 1A.

FIGS. 1A-C depict a kayak 10 according to an exemplary embodiment. As can be seen in FIG. 1A, the kayak 10 has a bow 12, a stern 14, a port side 16, and a starboard side 18. As can be seen in FIG. 1C, the kayak 10 also features a hull 20 on the underside and, as can be seen in FIG. 1A, a seating area 22 on the topside. The seating area 22 is disposed between the bow 12 and the stern 14 and includes at least one seat 24. Provided below the seat is a deck 26. Provided between the deck 26 and the hull 20 is a cavity defining an air volume 28, which provides buoyancy for kayak 10 and storage area as discussed below.

Figure 2A:
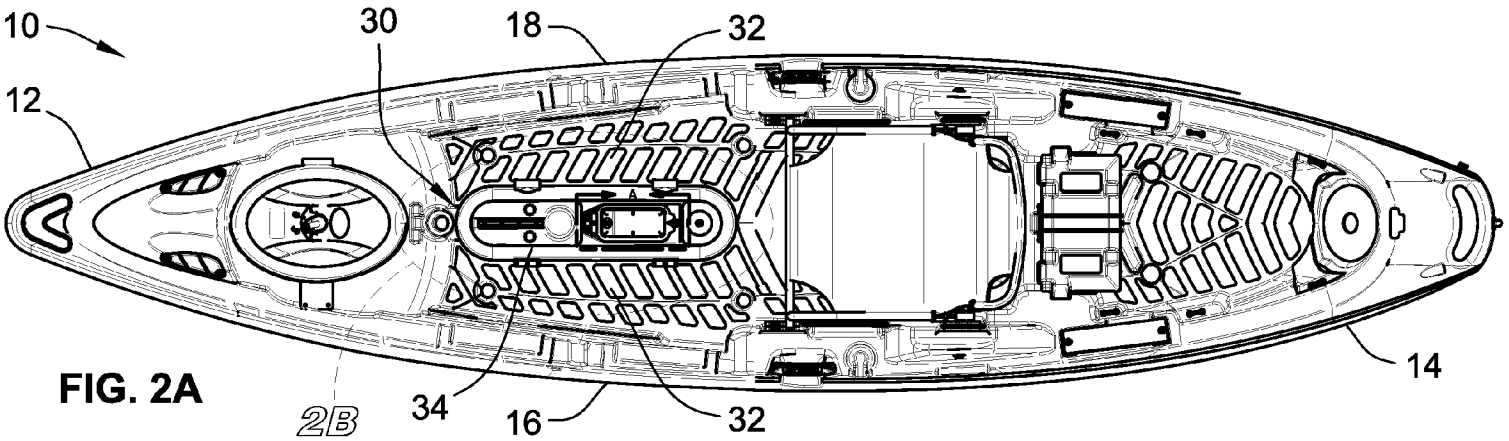
FIGS. 2A-B depict a cover for a storage compartment of a personal watercraft according to an exemplary embodiment.

Referring to FIG. 2A, disposed on the deck 26 is a storage compartment 30. The storage compartment 30, as shown, takes on a generally elongated shape, such as an elongated circle, an ellipse, a rounded or square rectangle, or other elongated polygons. In one embodiment, the elongated shape defines, in part, a foot placement area 32 around the storage compartment 30.

The storage compartment 30 is generally comprised of a cover 34 and an opening 36 (shown in FIGS. 1A-B). The opening 36 is formed through the deck 26 such that the opening 36 provides access to the air volume 28 between the deck 26 and the hull 20. The opening 36 can be even with the surface of the deck 26 or the opening 36 can be raised above the surface of the deck 26 such that a compartment perimeter wall 38 extends upwardly from the surface of the deck 26 as in the illustrated embodiment. In one embodiment in which the opening 36 is even with the surface of the deck 26, a ridge is provided around the periphery of the opening 36. The cover 34 selectively covers the opening 36 and selectively engages the top of the compartment wall 38 or the peripheral ridge to selectively secure the cover 34 to the watercraft. In preferred embodiments, the cover 34 engages the opening 36 in a watertight manner so as to prevent water from entering the storage compartment 30.

Figure 2B:
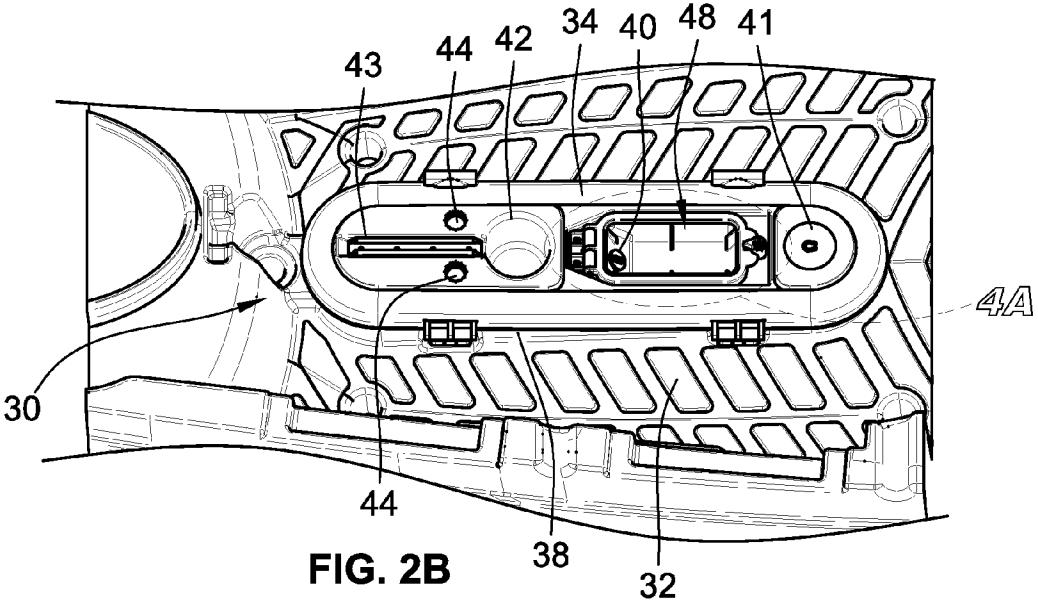

In various embodiments of the cover 34, several features are provided thereon for the convenient utilization by the kayak operator. As depicted in FIG. 2B, the cover 34 contains a dry storage chamber, such as a cellular device compartment 40, a magnetic surface 41, a cup holder 42, an equipment rail 43, and fishing rod holder mounting points 44. Despite the specific example of the dry storage chamber as a cellular device compartment, any of a variety of other objects can also be stored within the dry storage chamber. Additionally, while referred to as a "cellular device compartment," the compartment can also be used to store other objects, including other electronic devices, such as portable music players and tablets.

Figure 3A:
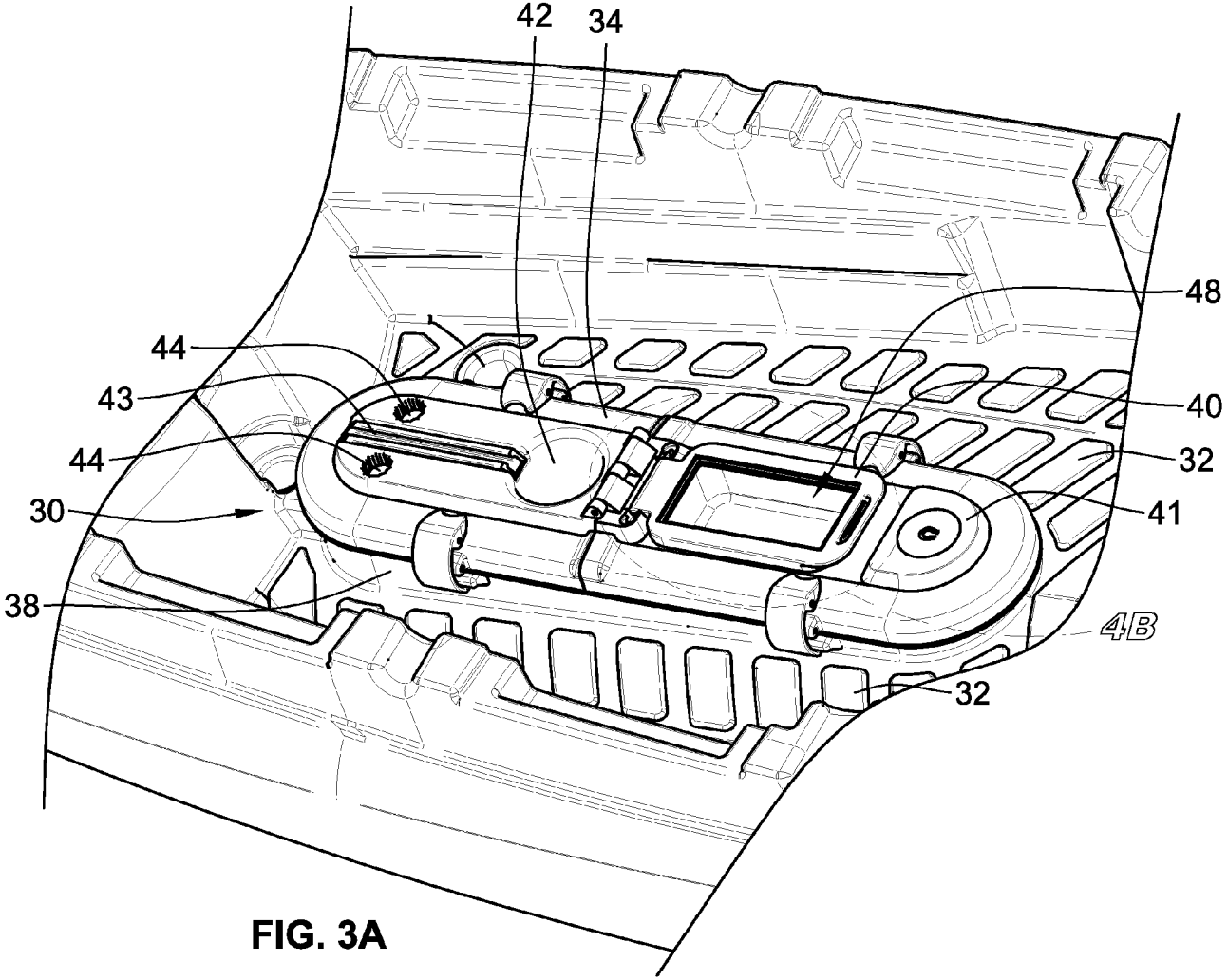
FIGS. 3A-B depict additional exemplary embodiments of the cover for a storage compartment of a personal watercraft.

The equipment rail 43 can be used to keep lures, hooks, and/or other small objects organized and secure for easy access. In embodiments, the equipment rail 43 is magnetized such that metallic objects can be securely attached to the equipment rail 43. The fishing rod holder mounting points 44 are designed to engage rod holders, such as rod holders sold under the Scotty trademark by Scott Plastics Ltd. of Sidney, British Columbia, Canada. A exemplary embodiment similar to that shown in FIGS. 2A and 2B is provided in FIG. 3A in which the cellular device compartment 40 is modified and the fishing rod holder mounts 44 have been moved.

Figure 3B:
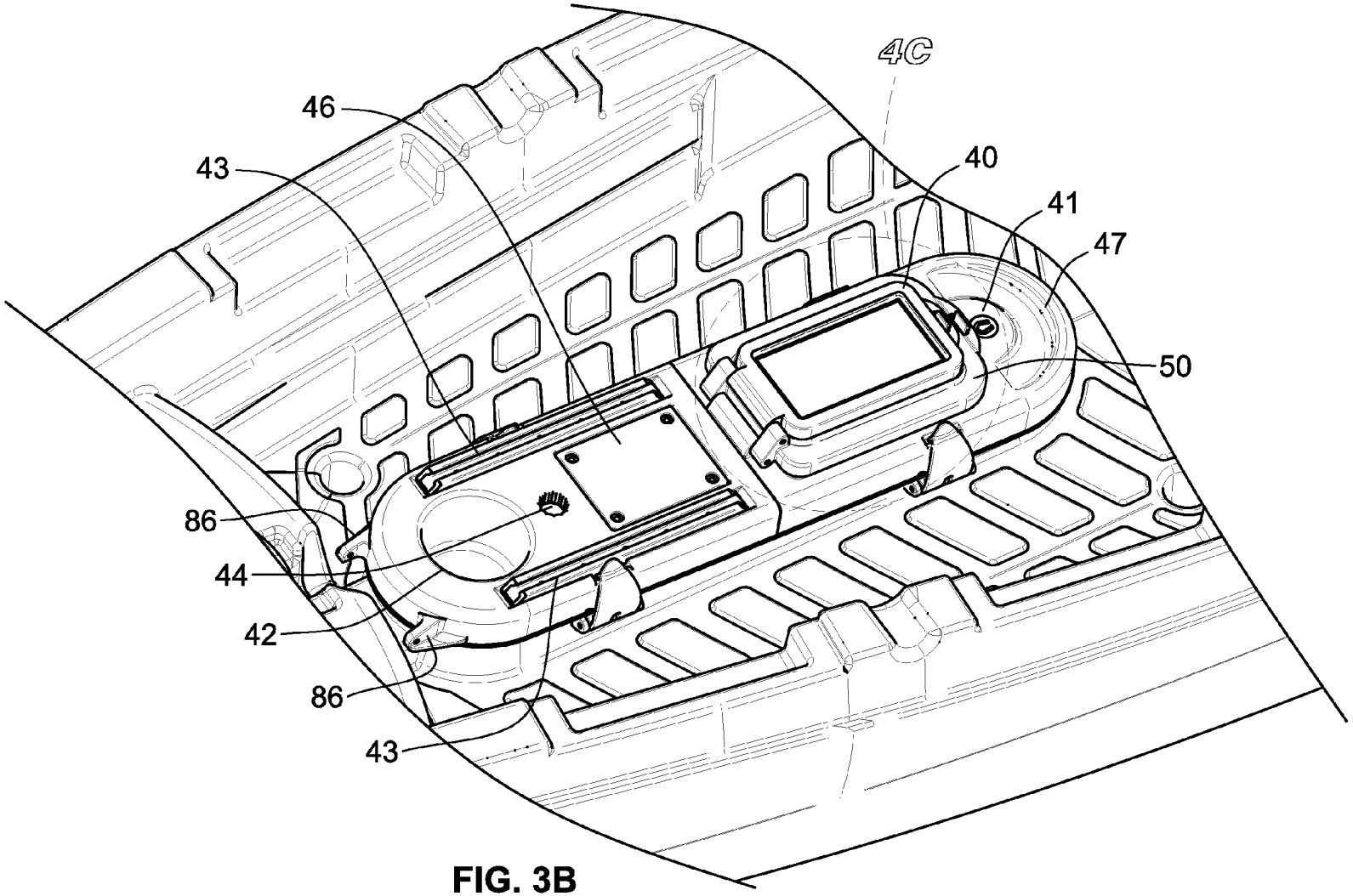

In still another embodiment of the cover 34 depicted in FIG. 3B, the cover 34 includes a dry storage chamber in the form of a cellular device compartment 40, a magnetic surface 41, a cup holder 42, two equipment rails 43, a fishing rod mounting point 44, a removable accessory mounting plate 46, and a surround tray 47. The accessory mounting plate 46 provides a stable point of attachment for larger objects, such as GPS displays, fish finders, solar panel, radio, and communications devices. In embodiments, the accessory mounting plate 46 can be removed to uncover a depression adapted to receive a variety of possible mounting structures that hold such exemplary items as GPS displays, fish finders, etc. The surround tray 47, as depicted in FIG. 2B, is a semicircular recessed tray designed to store small objects.

Figure 4A:
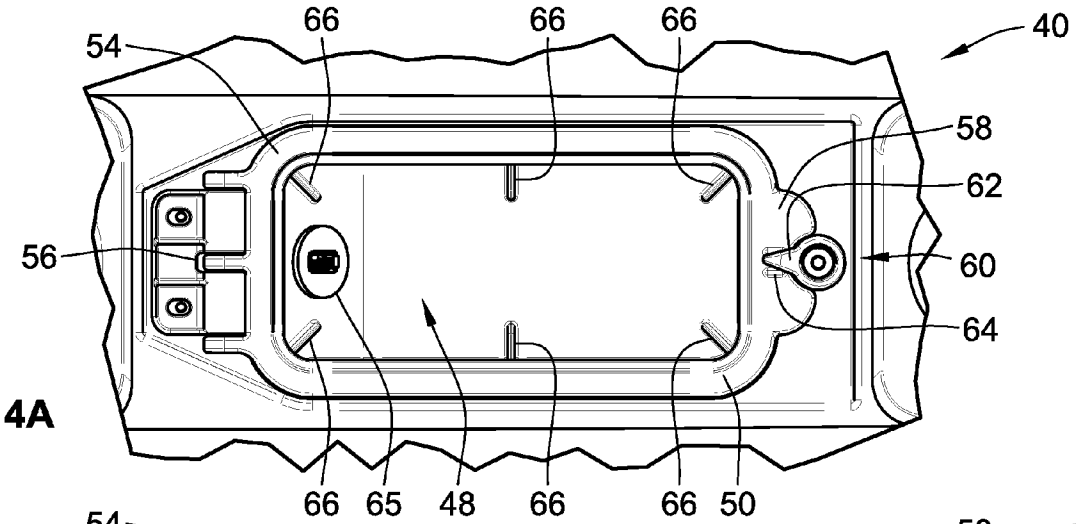
FIGS. 4A-C depict exemplary embodiments of the cellular device compartment of the cover.

In a particular embodiment of the cellular device compartment 40 shown in FIG. 4A, the cellular device compartment 40 is a depression 48 formed into the cover 34 and covered with a lid 50. The cellular device compartment 40 is rectangular in shape and sized so as to accommodate conventionally dimensioned smart phones. The lid 50 engages a peripheral lip (not shown) of the cellular device compartment 40 and can be affixed to the cover 34 at a first end 54 using a joint, such as a hinged joint 56. A second end 58 of the lid 50 selectively engages the cover 34 via a locking mechanism 60. The locking mechanism 60 as depicted in FIG. 4A is comprised of a rotating armature 62 that engages detents 64 located on the second end 58 of the lid 50. In an embodiment, the engagement between the lid 50 and the peripheral lip is watertight such as by using a gasket around the peripheral lip and an overlapping joint, such as a lap joint, between lid 50 and the lip.

Figure 4B:
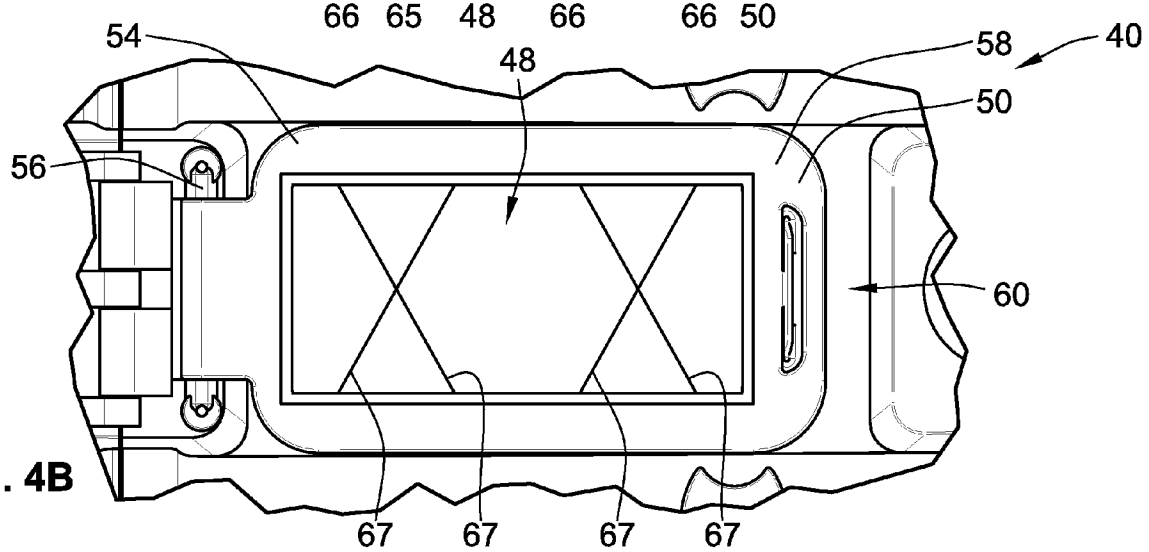

In an embodiment of the cellular device compartment 40, an electrical port 65, such as a USB or power outlet, is provided on the interior of the cellular device compartment 40. The electrical port 65 provides electrical communication through the wall of the cellular device compartment 40 to the area below the cover 34, which can contain a battery for such exemplary items as a cellular device, GPS display, or a fish finder. In another embodiment, the interior of the cellular device compartment 40 features ribs 66 that keep the cellular device off the floor of the cellular device compartment 40. Thus, the ribs 66 keep the cellular device from sitting in water should any enter the compartment 40 and allows for the accommodation of charging cables underneath the cellular device. Alternatively or in conjunction with the ribs 66, the cellular device compartment can be provided with elastic cords 67, as shown in FIG. 4B, that secure the stored device in close physical proximity to the lid 50. In still another embodiment, the lid 50 of the cellular device compartment 40 is comprised of a clear material, such as PET, PMMA, polycarbonate, or glass. The clear lid 50 allows the operator to see notifications or incoming calls on the screen of the cellular device. In some embodiments, the lid may be configured to allow manipulation of the device stored therein.

Figure 4C:
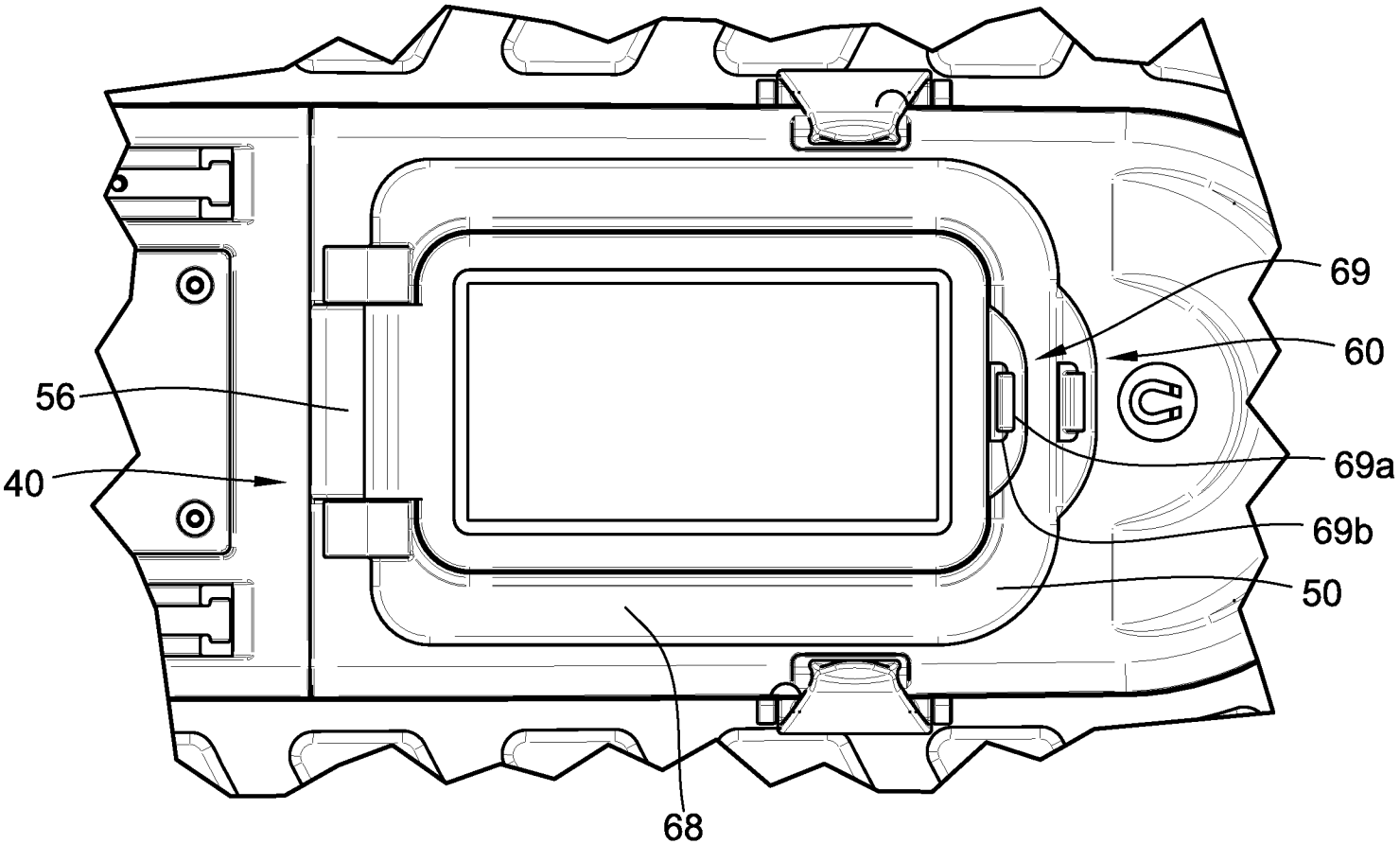

In yet another embodiment of the cellular device compartment 40 shown in FIG. 4C, a frame 68 and the lid 50 form the compartment for storing the cellular device. In this embodiment, the cellular device compartment 40 is defined by the thickness of the frame 68, such that the thickness generally matches the thickness of a conventional cellular device, including a protective cover. In this embodiment, the depression 48 and the lid 50 thus form an additional storage bin. As shown in FIG. 4C, the frame 68 is secured to the lid 50 using a snap-fit lock 69. The snap-fit lock 69 is comprised of an arm that extends upwardly from the lid 50 with an angled protrusion 69*a* located at the upper end of the arm. The frame 68 features an aperture 69*b* that engages the angled protrusion 69*a*, causing the arm to deflect while the angled protrusion 69*a* is inserted through the aperture 69*b* from the underside of the frame 68. Once the angled protrusion 69*a* passes through the aperture 69*b*, the arm recovers to its original position, causing the angled protrusion 69*a* to pin the frame 68 against the lid 50. Gaskets on the underside of the frame and/or an overlapping joint between the frame 68 and lid 50 can be used to provide a watertight seal.

Figure 5A:
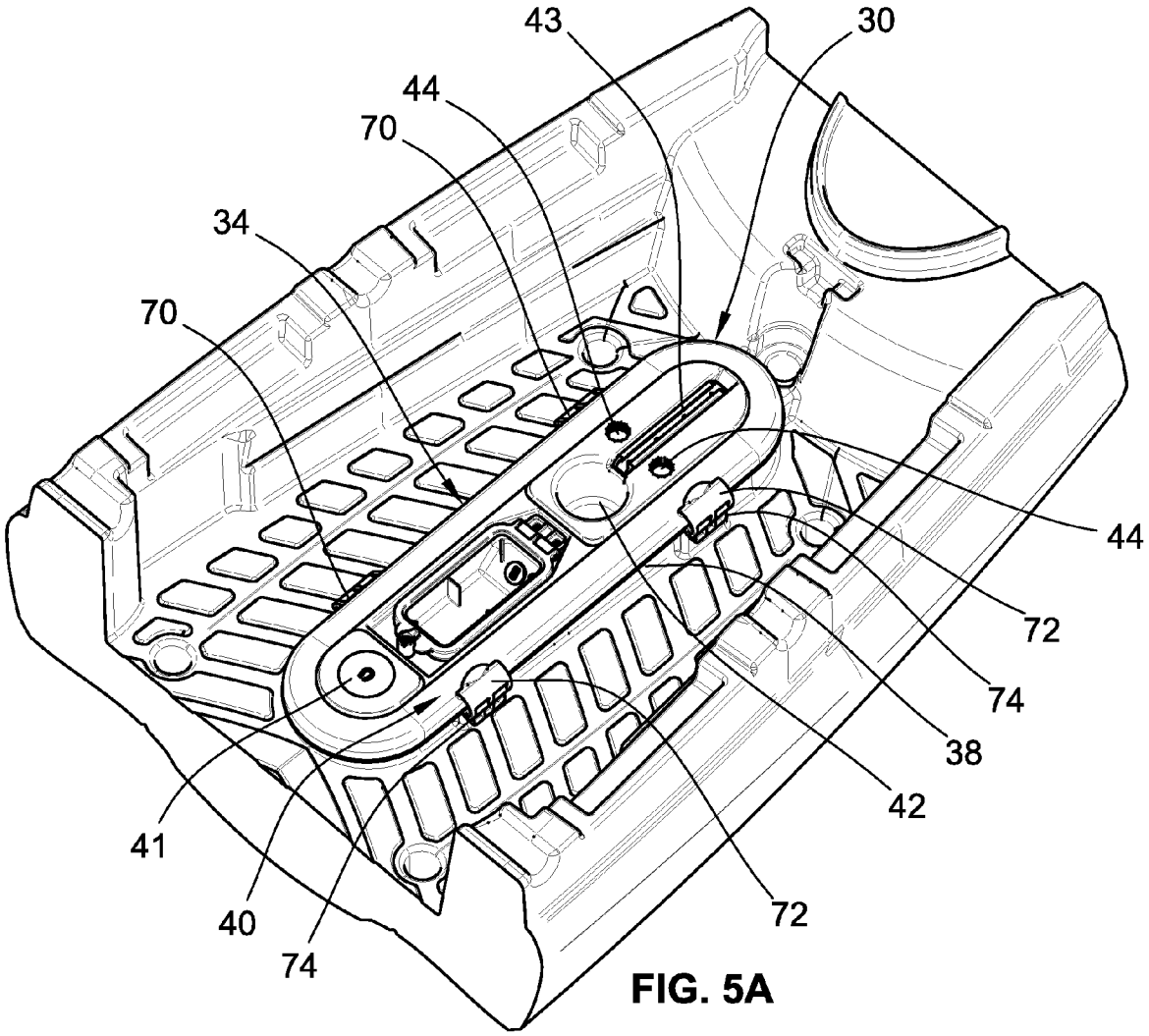
FIGS. 5A-G depict a side hinge embodiment according to an exemplary embodiment.
Figure 5B:
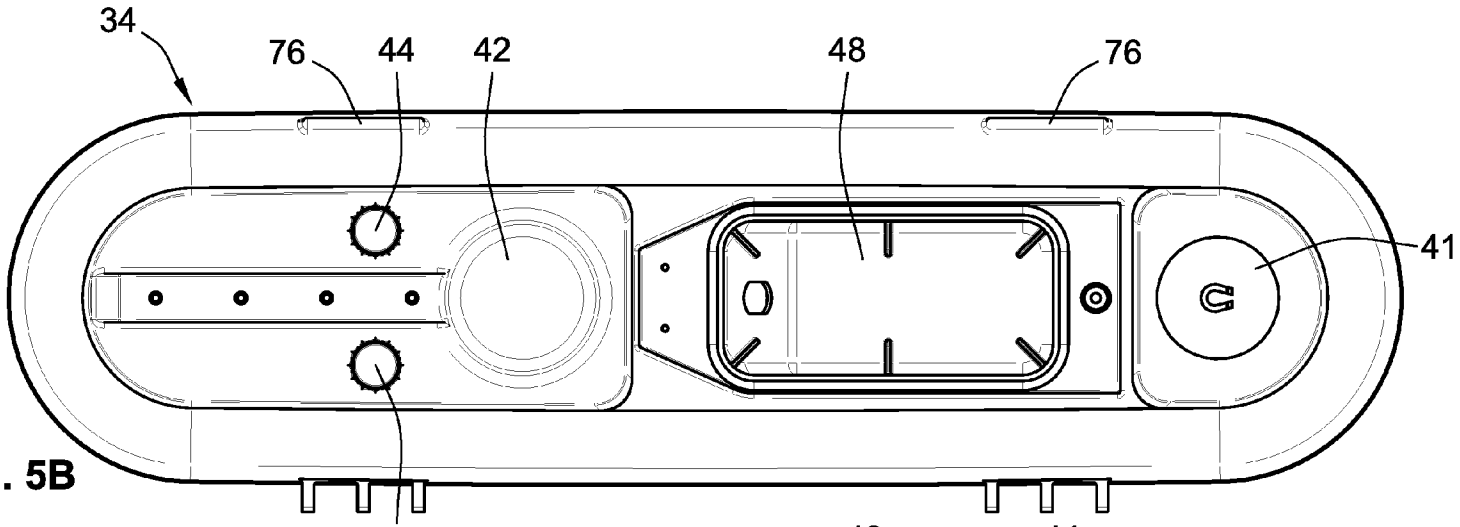
Figure 5C:
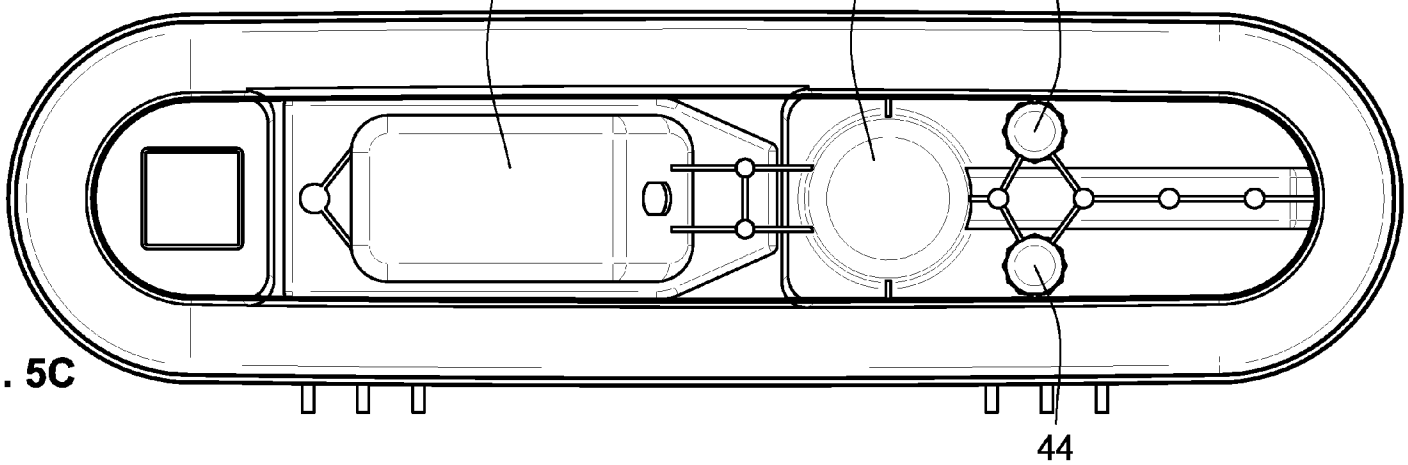
Figure 5D:
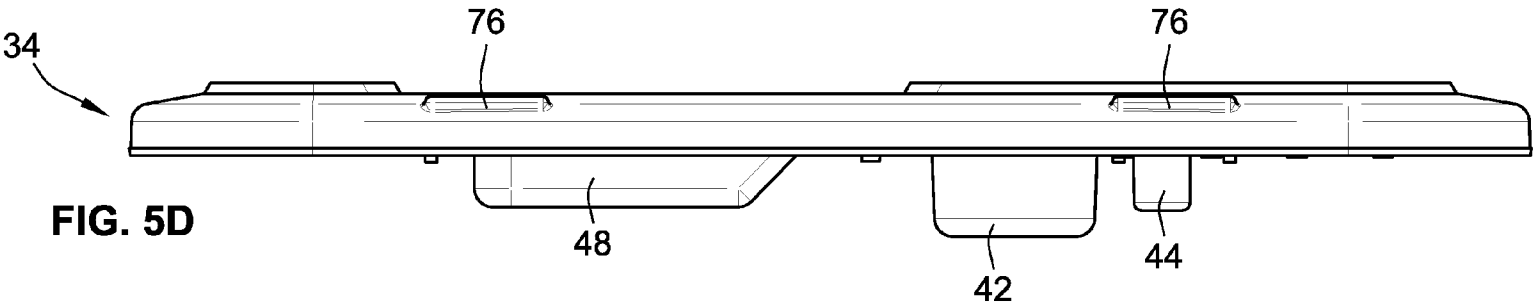
Figure 5E:
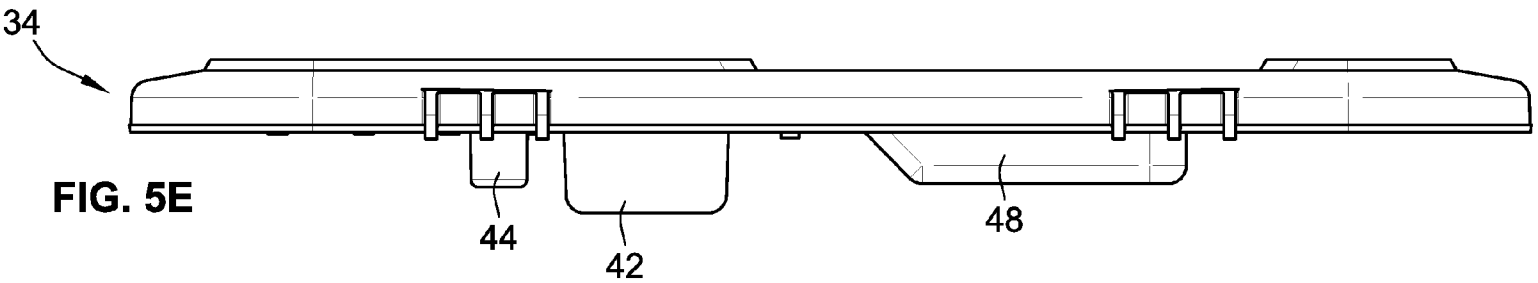
Figure 5G:
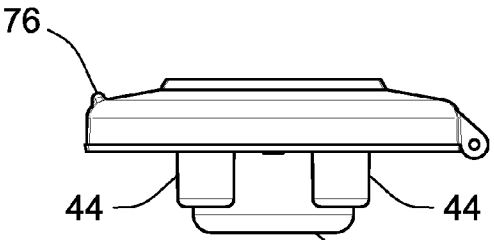
Figure 5F:
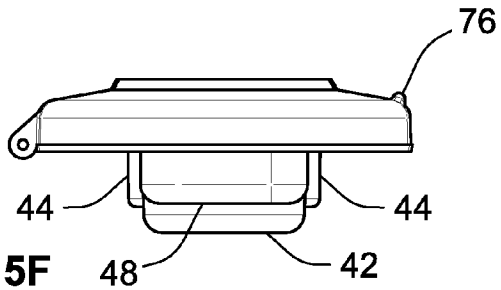
Figure 5H:
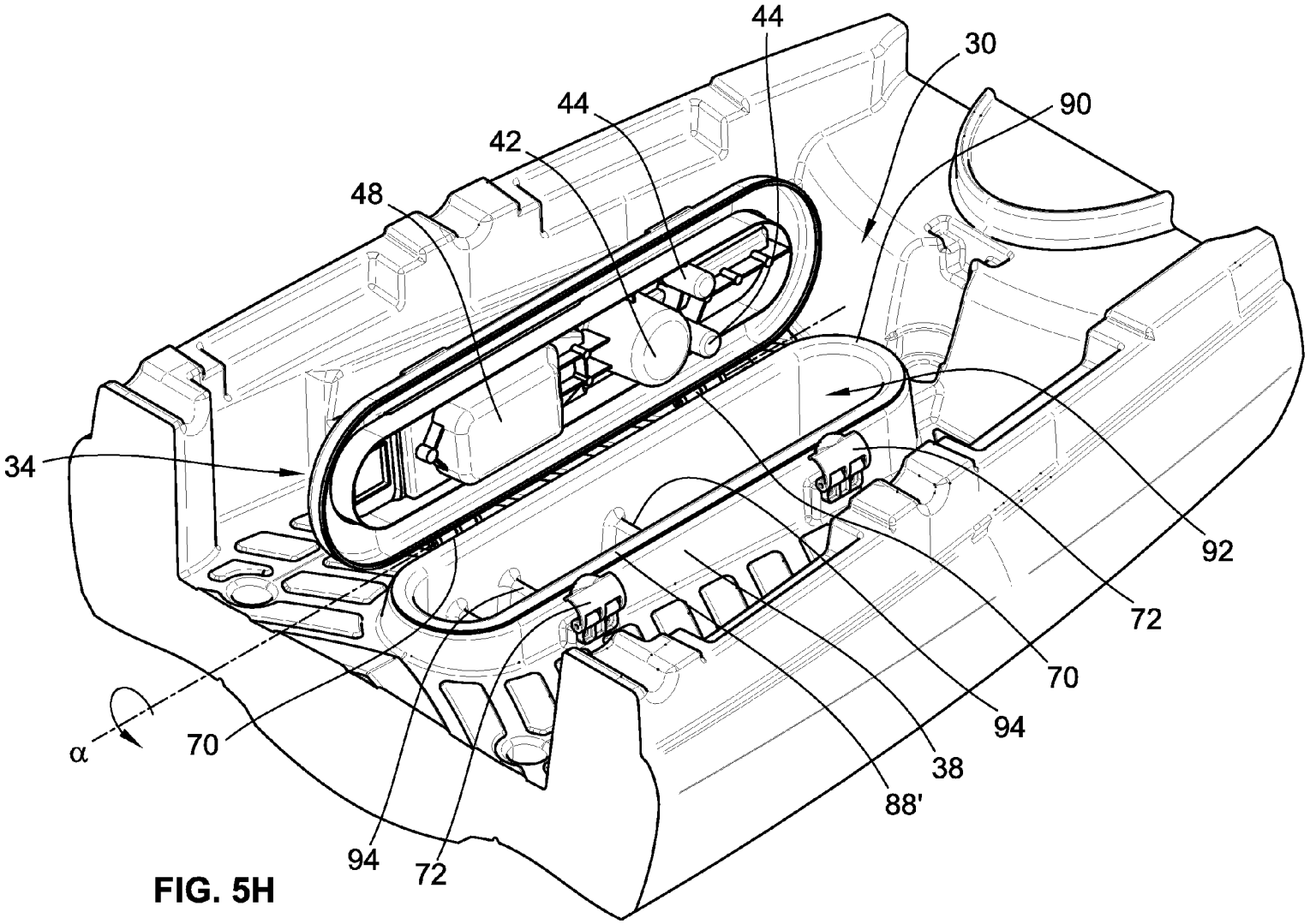
FIG. 5H depicts the side hinge embodiment of FIG. 5A shown in the open configuration.

In a particular embodiment shown in FIG. 5A and referred to as the "side hinge embodiment," the cover 34 is a single-body construction is rotatably connected proximal to one edge of the opening 36. Various views of the cover 34 of the side hinge embodiment are provided in FIGS. 5B-G. Returning to FIG. 5A, on a first side of the opening 36 is at least one hinge 70. The hinges 70 are securably mounted to either the deck 36 or the compartment perimeter wall 38. In an embodiment, there are two hinges 70 on the compartment perimeter wall 38 (shown in FIG. 2B). On a second side of the opening 36 that is opposite to the first side is at least one latch 72, such as a simple latch, an over center latch, a toggle clamp, and/or a draw latch. FIG. 5A depicts two latches 72 that rotate on hinge plates 74 mounted on the compartment perimeter wall 38 and engage mating surfaces 76 on the cover 34; however, the latches 72 can also be provided on the cover 34 such that the latches engage mating surfaces 76 (shown in FIG. 5B) on the compartment perimeter wall 38. As shown in FIG. 5H, to open and close the storage compartment 30, the cover 34 is unlatched and rotated along an axis α defined by the hinges 70. In one embodiment, the cover 34 is stabilized in the open configuration using a stop cord (not shown), such as a bungie cord. In such an embodiment, the stop cord can be attached to the interior or exterior of the compartment perimeter wall 38 at one or both ends of the cover 34.

Figure 6A:
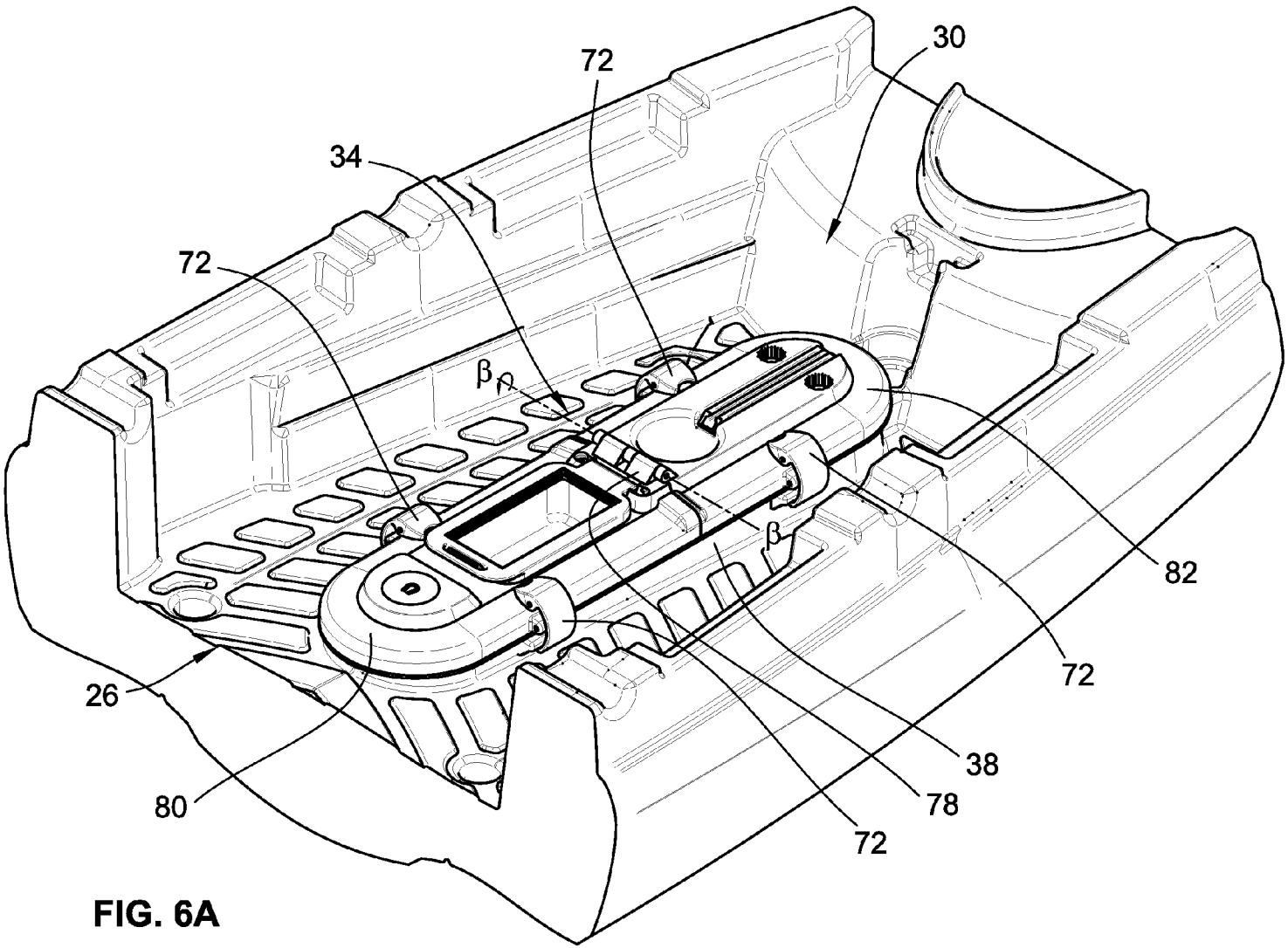
FIGS. 6A-B depict a center hinge embodiment in the open and closed configurations according to an exemplary embodiment.
Figure 6B:
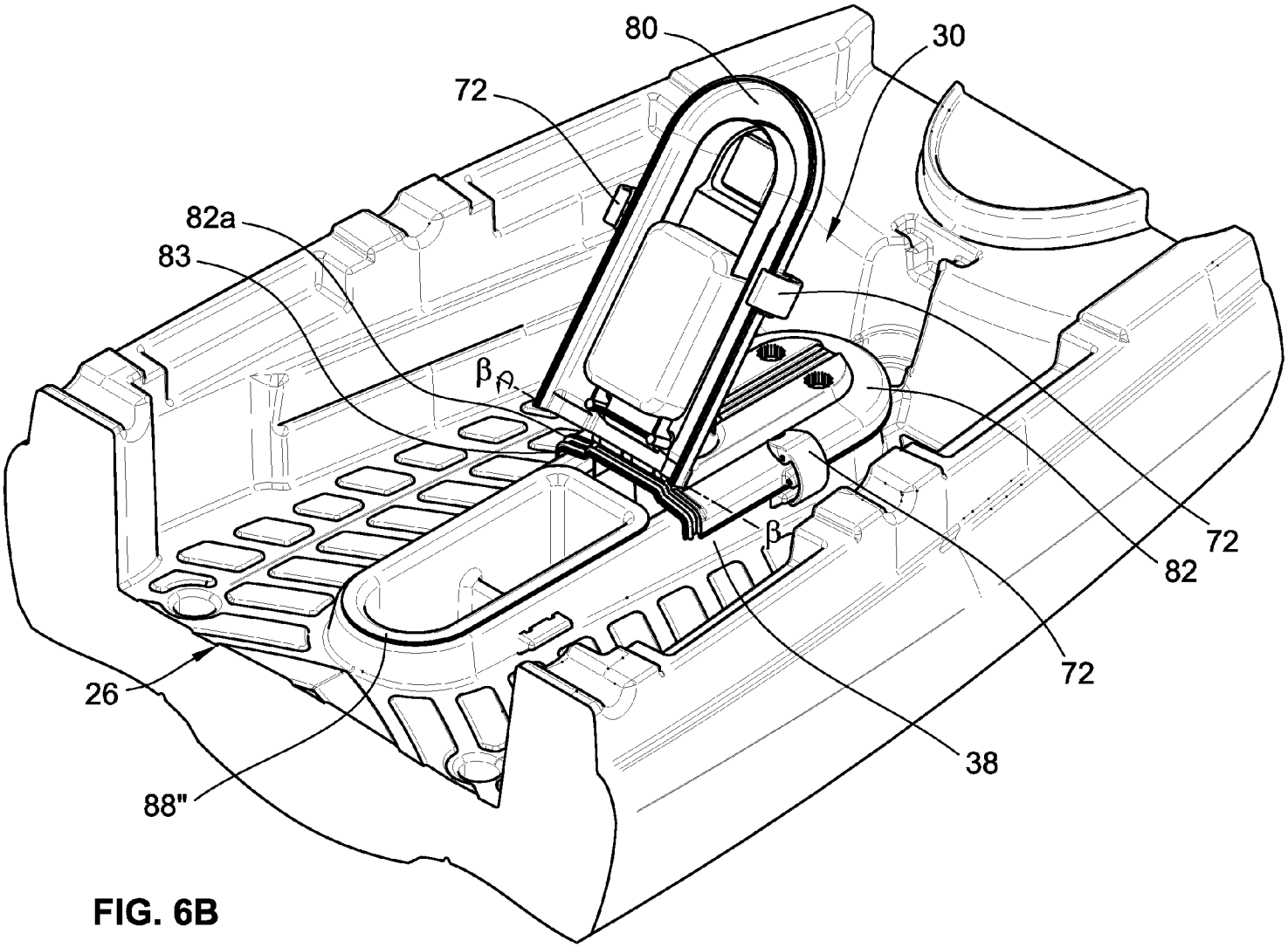

In another embodiment shown in FIG. 6A and referred to as the "center hinge embodiment," an exterior center hinge 78 is provided across the mid-region of the cover 34, dividing the cover 34 into a first end 80 and a second end 82. While described as a "center hinge," the hinge 78 need not actually be placed in the center of the cover 34; instead, the hinge can be placed anywhere along the longitudinal axis of the cover 34 such that the cover 34 is subdivided into a first end 80 and a second end 82. In a particular embodiment shown in FIG. 6B, the second end 82 features a region 82*a* that at least partially inserts into the first end 80 and in which the region 82*a* has a gasket 83 that seals the joint between the first end 80 and the second end 82. As depicted in FIG. 6A, the center hinge 78 is located between the cellular device compartment 40 and the cup holder 42. In a particular embodiment, the cover 34 is secured over the opening 36 using four latches 72: two latches 72 securing the sides of the first end 80 and two latches 72 securing the second end 82. As shown in FIG. 6A, the latches 72 are mounted to the cover 34, but they could instead be mounted to the compartment perimeter wall 38. To open the compartment 30, the operator unlatches the two latches 72 of either the first end 80 or the second end 80. FIG. 6B shows the two latches 72 on the first end 80 as unlatched such that the first end 80 is able to rotate upwardly about an axis β defined by the exterior center hinge 78. In this way, half of the storage compartment 30 is exposed for access. The operator could similarly unlatch the two latches 72 on the second end 82 and rotate the second end 82 upwards to expose the other half of the storage compartment 30. Additionally, the operator could unlatch all four latches 72 to completely remove the cover 34 from the storage compartment 30. In an embodiment, the first end 80 and the second end 82 are attached via a stop cord (not shown), such as a bungie cord, that is connected between the interior surfaces of the first end 80 and the second end 82.

In another embodiment of the center hinge embodiment, three latches 72 and one hinge 70 are used to secure the cover 34 to the storage compartment 30. As in the previous embodiment, the operator can unlatch two latches 72 to expose half of the storage compartment 30. To expose the entire storage compartment 30, the operator unlatches the remaining latch 72 and rotates the cover 34 about the axis α defined by the single hinge 70. One advantage of this embodiment is that the cover 34 is permanently attached to the kayak 10 such that the cover 34 cannot become lost upon removal.

Yet another configuration of the center hinge embodiment is shown in FIGS. 13A-13H. As can be seen in the top view of cover 34 shown in FIG. 13A and perspective views FIGS. 13G and 13H, the cover 34 includes center hinge 78 joining the first end 80 and the second end 82. The cover 34 also includes a plurality of latches 72 (e.g., four latches as shown in FIGS. 13A-H) for securing the cover to the opening of the storage compartment. A dry storage chamber 40 is provided having a lid 50 and a locking mechanism 60. The lid 50 opens and closes by rotating about hinged joint 56 when the locking mechanism 60 is not engaged. The lid 50 can be opaque, translucent, or clear. On top of the lid 50 are elastic cords 67 for securing items to the lid for quick access by the kayak operator. Also provided on the cover 34 are two equipment rails 43, an accessory mounting plate 46, a cup holder 42, and a magnetic surface 41. As shown in the bottom view of FIG. 13C, the magnetic surface 41 is magnetized by placing one or more magnets (not shown) in a magnet holder box 45 on the underside of the cover 34. As can be seen in the side views FIGS. 13B, 13D, 13E, and 13F, a watertight membrane 81 is provided around the bottom of the cover 34. As shown primarily in FIGS. 13B and 13D, a small break in the watertight membrane 81 is provided at the location of the center hinge 78 to facilitate rotation of the first end 80 and/or second end 82 of the cover 34 so as to access the interior of the storage compartment. The watertight membrane 81 engages the opening 36 (as shown in FIGS. 1A-1B) when the cover 34 is closed to prevent water from entering the storage compartment 30. While the watertight member 81 is depicted in conjunction with the embodiment shown in FIGS. 13A-13H, the watertight member 81 can be used with any of the covers 34 disclosed or contemplated herein. The watertight membrane 81 can be made of any of a variety of suitable watertight materials. In the embodiment shown, the watertight membrane is a rubber material adapted to elastically deform around the opening 36 of the storage compartment 30 to provide a water tight seal for the cover 34.

Figure 7A:
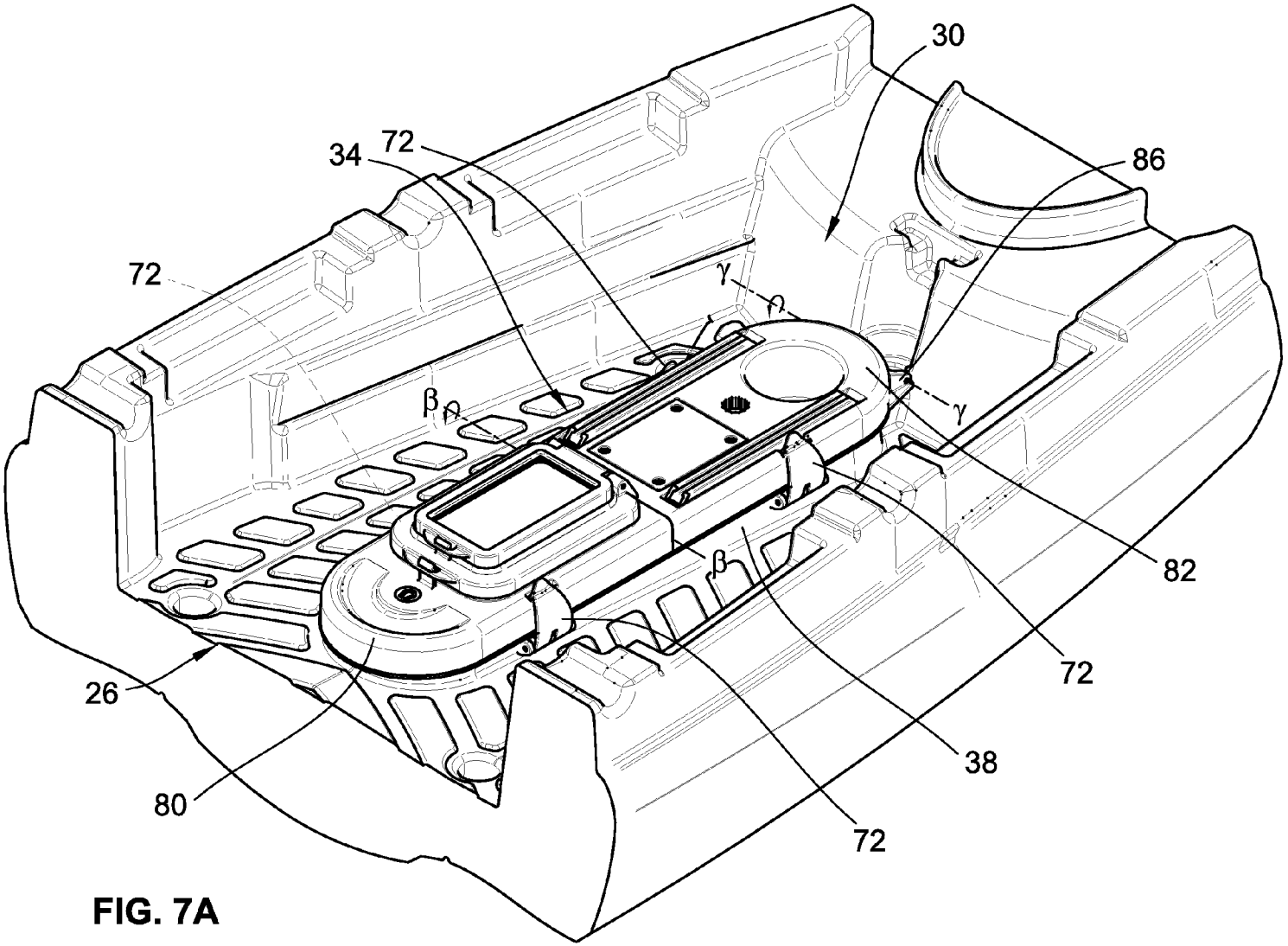
FIGS. 7A-B depict an inch worm embodiment in the open and closed configurations according to an exemplary embodiment.
Figure 7B:
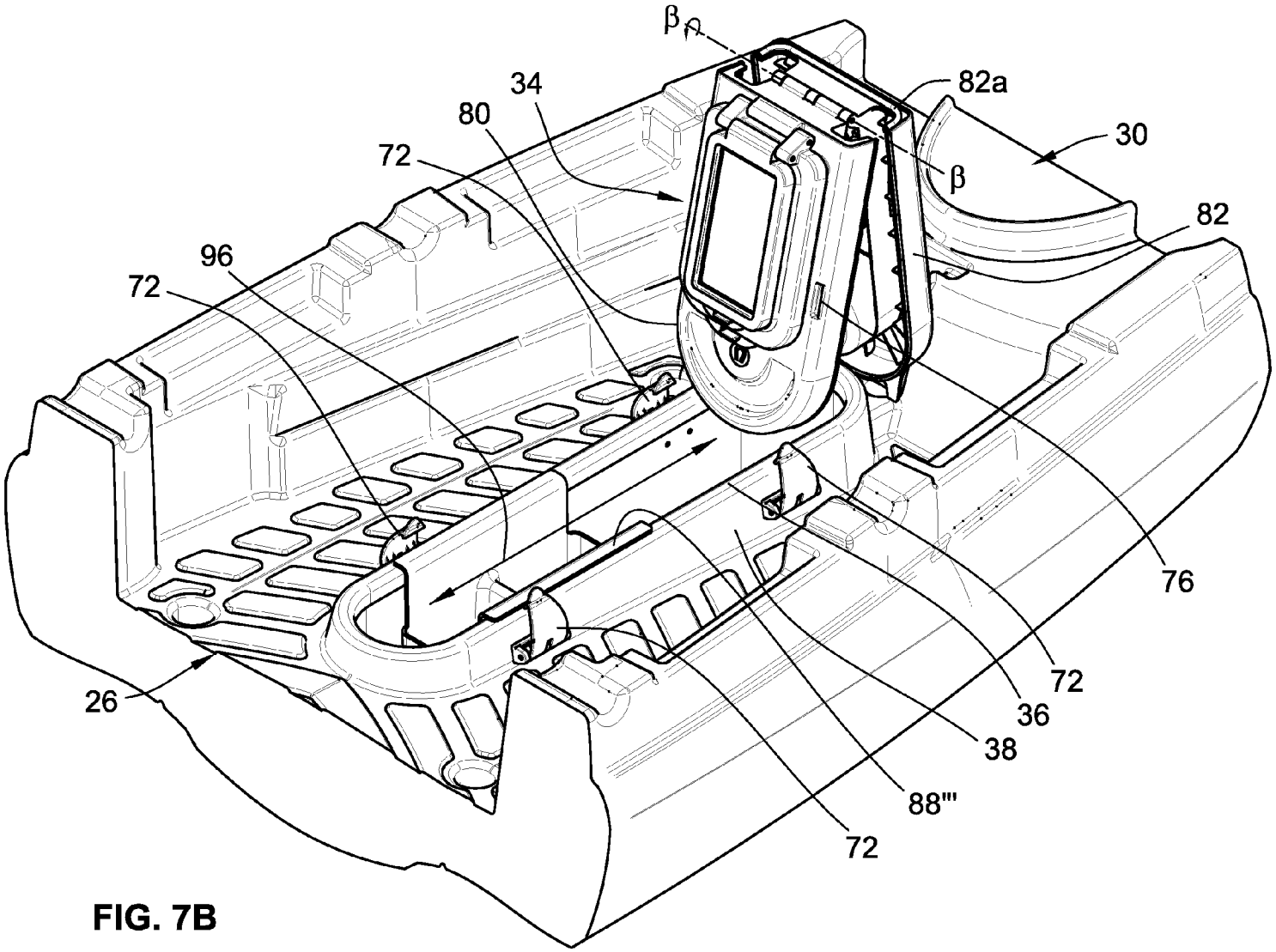

In still another embodiment shown in FIG. 7A and referred to as the "inch worm embodiment," the cover 34 features an interior center hinge 84 and an end hinge 86 (shown most clearly in FIG. 3B). In a particular embodiment similar to the center hinge embodiment, the second end 82 features a region 82*a* that at least partially inserts into the first end 80 and in which the region 82*a* has a gasket 83 that seals the joint between the first end 80 and the second end 82. In the embodiment shown in FIG. 7A, the interior center hinge 84 provides rotation downwardly about the axis β. Additionally, the end hinge 84 is depicted as being located at the second end 82, but it could instead be located at the first end 80. The first end 80 and the second end 82 are reversibly secured to the compartment perimeter wall 38 via four latches 72. As shown in FIG. 7B, to open the storage compartment 30, the operator unlatches all four latches 72. The operator then lifts the cover 34, causing it to break at the interior center hinge 84 with the first end 80 rotating downwardly about axis β. The second end 82 is secured to the compartment perimeter wall 38 at the end hinge 86. Thus, when lifting the cover 34 upwardly, the second end 82 will rotate upwardly about an axis γ defined by the end hinge 86. The simultaneous rotation of the first end 80 downwardly at the interior center hinge 84 and the second end 82 upwardly at the end hinge 86 will cause the cover to fold in half. The operator can then use the first end 80 as a leg to prop up the cover 34 in a vertical position by resting the first end 80 in the opening 36. In this way, the operator can, for instance, prop the cellular device compartment 40 to face the operator while kayaking. Additionally, the operator could instead rotate the cover 34 about the axis γ approximately 180° to expose the entire length of the opening 36. Further embodiments may include a groove that positively engages the second end 82 in the folded position to secure the lid in the open position. A bungie cord or other resilient material could be used to secure the two components in the folded orientation illustrated in FIG. 7B.

As discussed above, the opening 36 provides access to the air volume 28 between the deck 26 and the hull 20. Accordingly, the operator can store equipment, such as fishing rods, trolling motors, fish finders, and batteries, within the air volume by inserting such equipment through the opening 36.

However, additional storage for smaller items is provided with the use of removable trays 88' that are designed to removably engage the opening 36. An exemplary embodiment of a tray is shown in FIG. 5H. Each tray 88' has an outwardly protruding lip 90 extending around at least a portion of the perimeter of the tray 88'. In an embodiment, the lip 90 engages at least a portion of two sides of the opening 36 to secure the tray 88' within the opening 36. Thus, the operator inserts the tray 88' into the opening 36 of the storage compartment 30 such that the tray 88' extends into the air volume 28 defined by the deck 26 and hull 20. As the hinges 70 and/or latches 72 are secured to the deck 26 or the compartment perimeter wall 38, the cover 34 can be secured over the opening 36 with one or more trays 88 inserted therein. The trays 88' can be divided into two or more compartments 92 using dividers 94. The dividers can be integrally molded with the tray 88', as shown in FIG. 5H, or they can be reversibly insertable. In an embodiment with selectively insertable dividers 94, the size of the compartments can be customized by moving the dividers 94 between provided dividing points. Additionally, the dividers 94 can extend to a height corresponding to the entire depth of the tray 88' or a height corresponding to only part of the depth of the tray 88'. Additionally, the tray 88' can contain dividers 94 of varying heights. Various embodiments of trays 88' are provided in the figures. FIGS. 8A-8H depict a full tray 88'; FIGS. 9A-9G depict a half tray 88"; and FIGS. 10A-10H depicts a sliding tray 88'''.

Figure 8B:
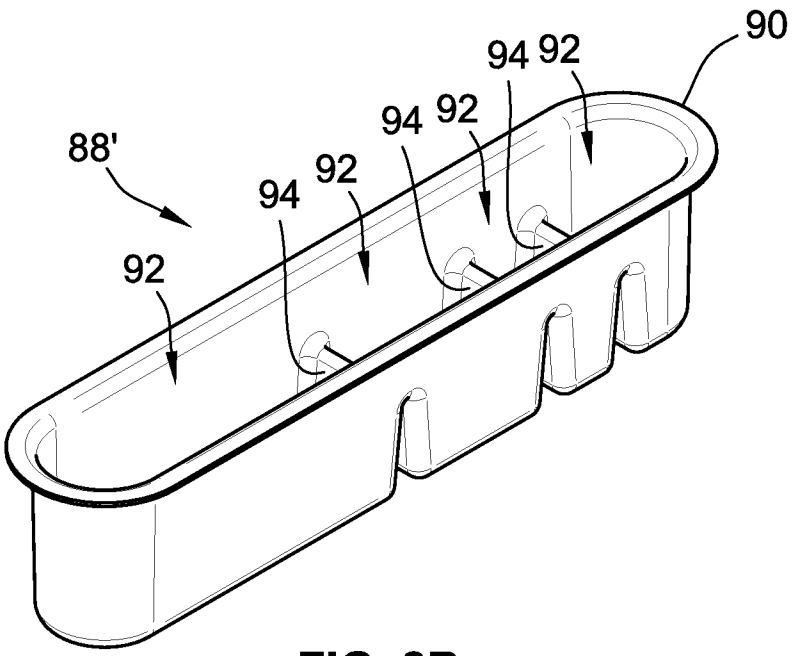
FIGS. 8A-H depict a full tray according to an exemplary embodiment.
Figure 8A:
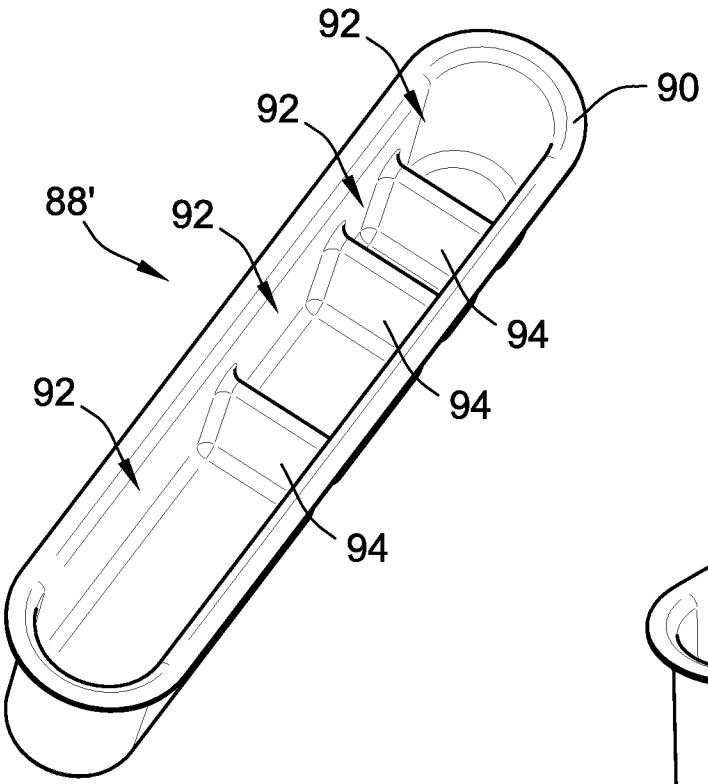
Figure 8D:
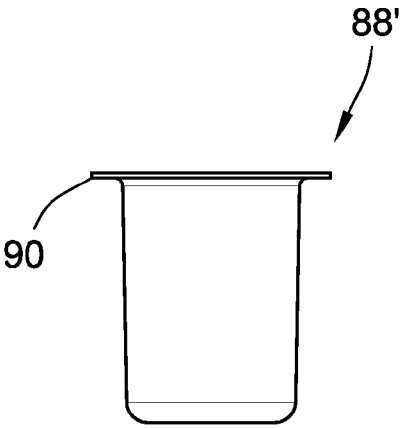
Figure 8C:
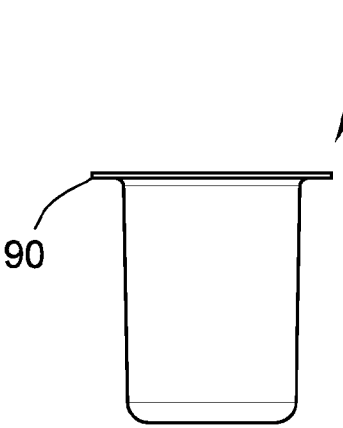
Figure 8E:
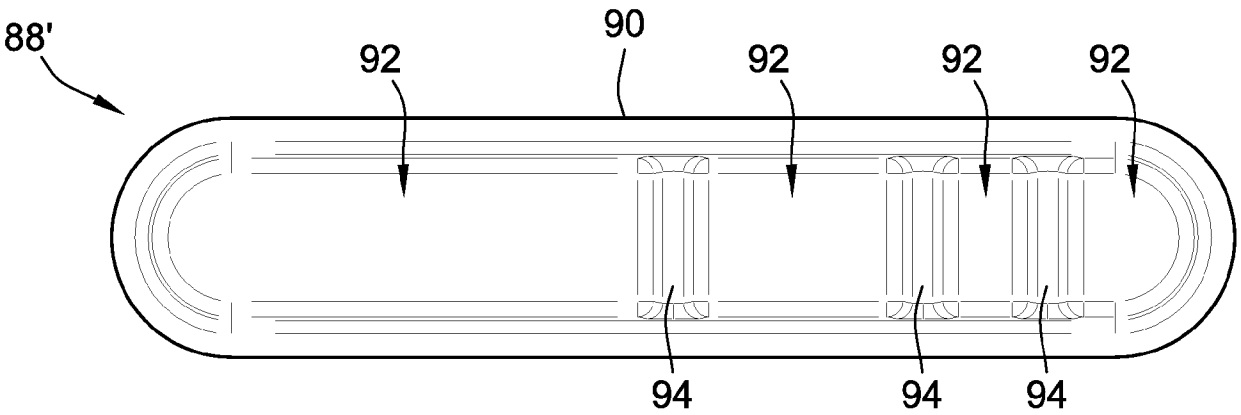
Figure 8F:
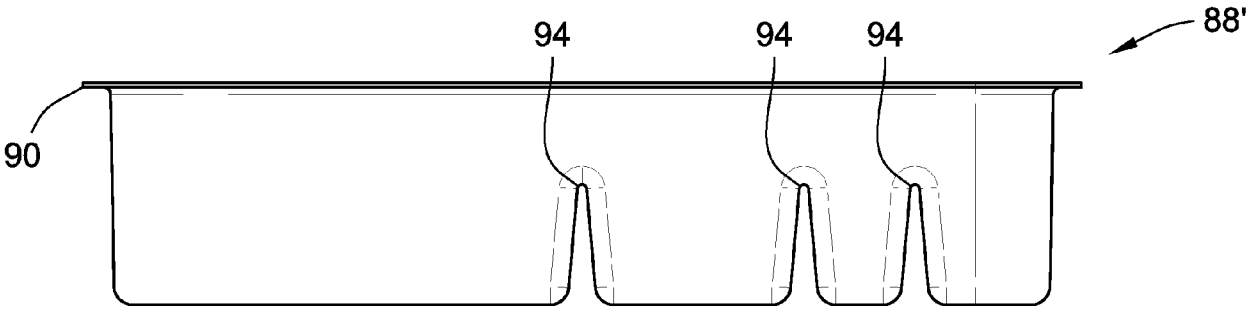
Figure 8G:
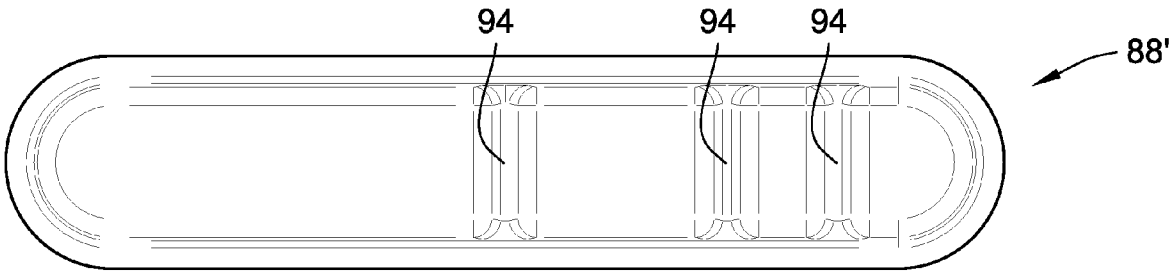
Figure 8H:
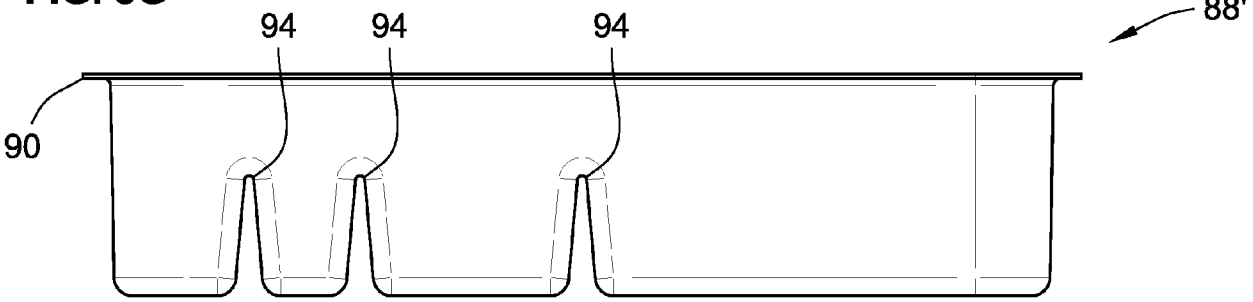

As can be seen in FIG. 5H, the full tray 88' is designed occupy substantially the entire opening 36 and, thus, includes ends and edges that match the shape of the opening 34. As can be seen in FIG. 8A, the full tray 88' is divided into four compartments 92 using integrally molded dividers 94. The tray provides a large compartment, a medium-sized compartment, and two small compartments corresponding to approximately half the opening, approximately a quarter of the opening, and approximately an eighth of the opening, respectively. In other embodiments, the full tray 88' can contain more or less compartments or compartments of equal or different sizes.

Figure 9B:
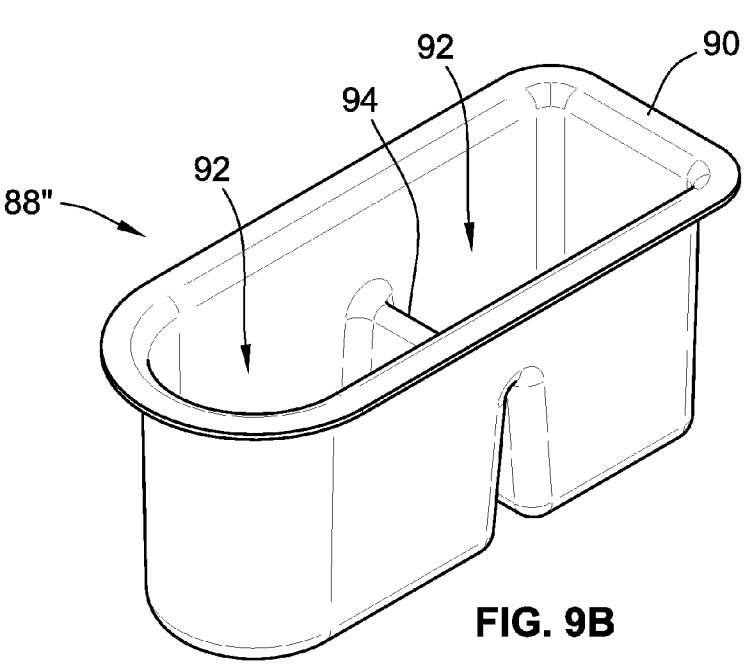
FIGS. 9A-G depict a half tray according to an exemplary embodiment.
Figure 9C:
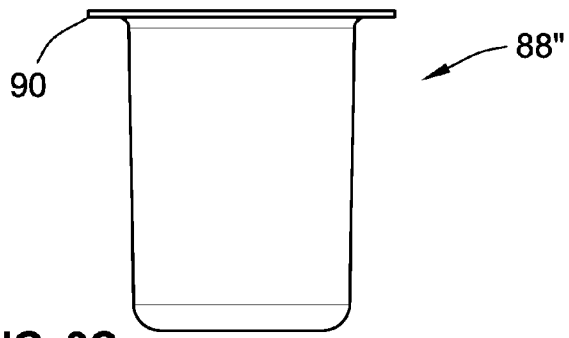
Figure 9A:
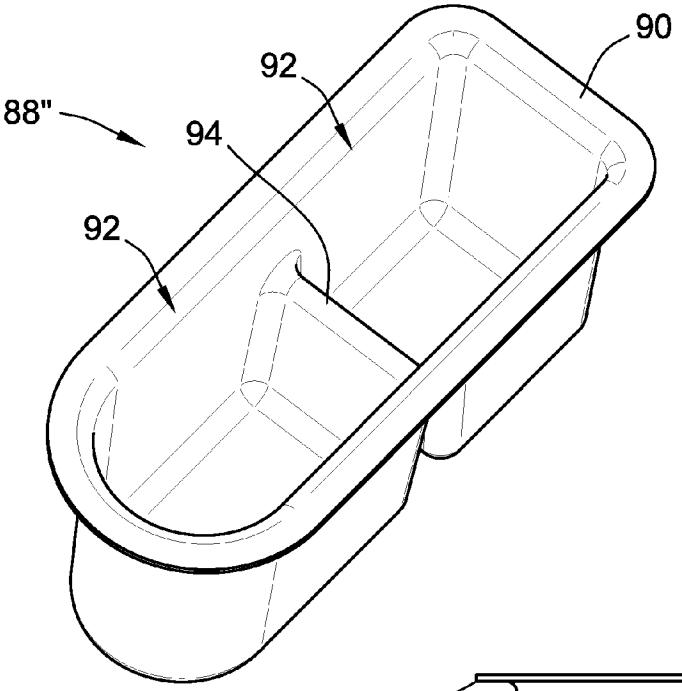
Figure 9E:
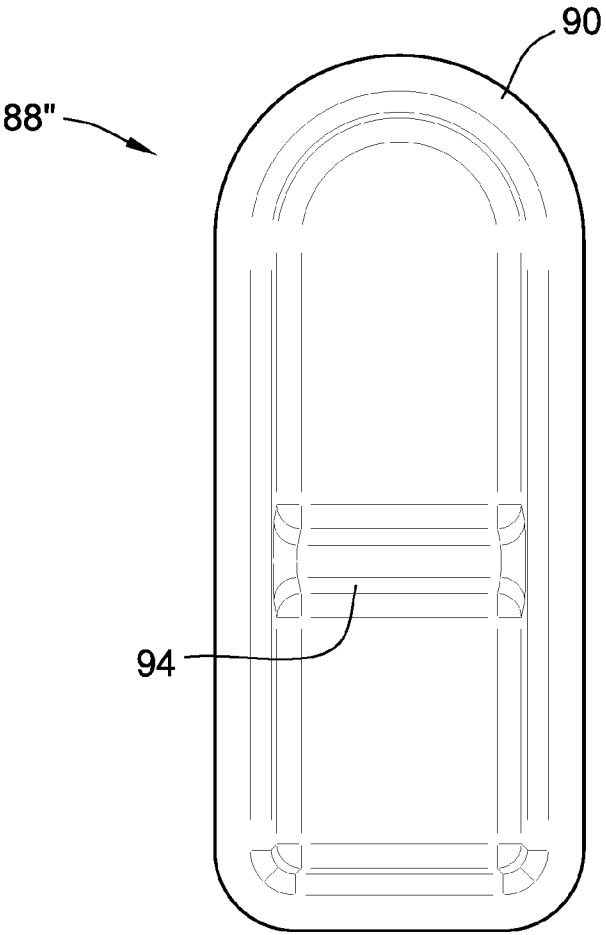
Figure 9D:
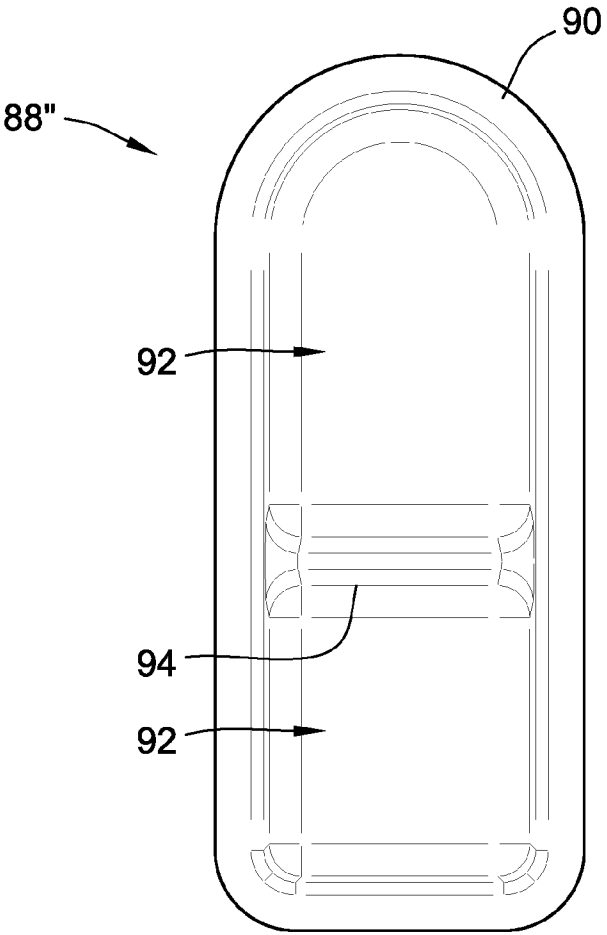
Figure 9F:
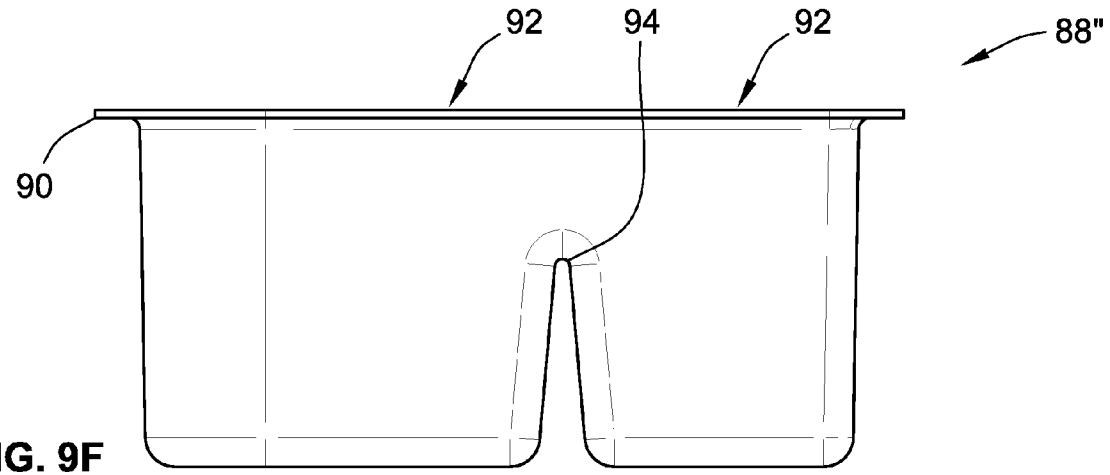
Figure 9G:
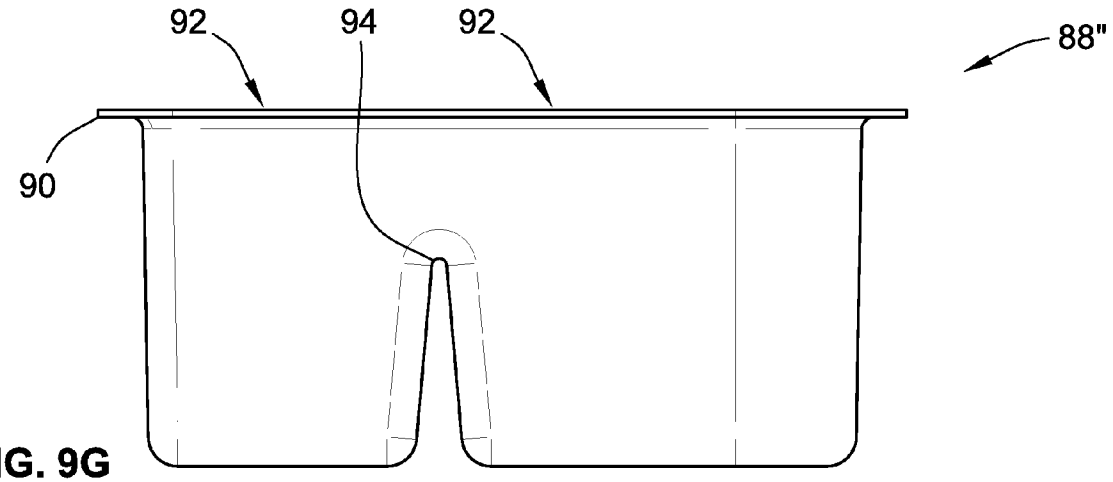

As can be seen in FIG. 6B, the half-tray 88" is designed to occupy substantially half the opening 36 and, thus, contains a single end that matches the shape of the opening 34. As can be seen in FIG. 9A, the half-tray 88" is divided into two compartments 92 using one integrally molded divider 94. One compartment 92 is depicted as being slightly larger than the other compartment 92. In other embodiments, the half-tray 88" can contain more or less compartments or compartments of equal or different sizes. Because the half tray 88" only occupies half the opening 36, the operator still has convenient access to the air volume 28 beneath the deck 26 without removing the half tray 88" or by sliding the tray toward the other end of the opening.

Figure 10B:
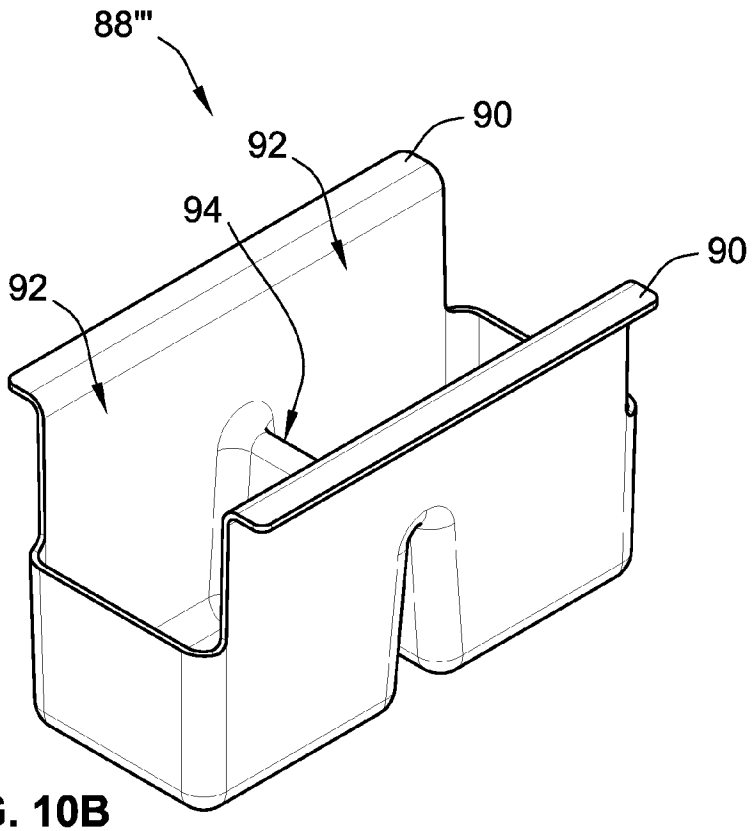
FIGS. 10A-H depict a sliding tray according to an exemplary embodiment.
Figure 10A:
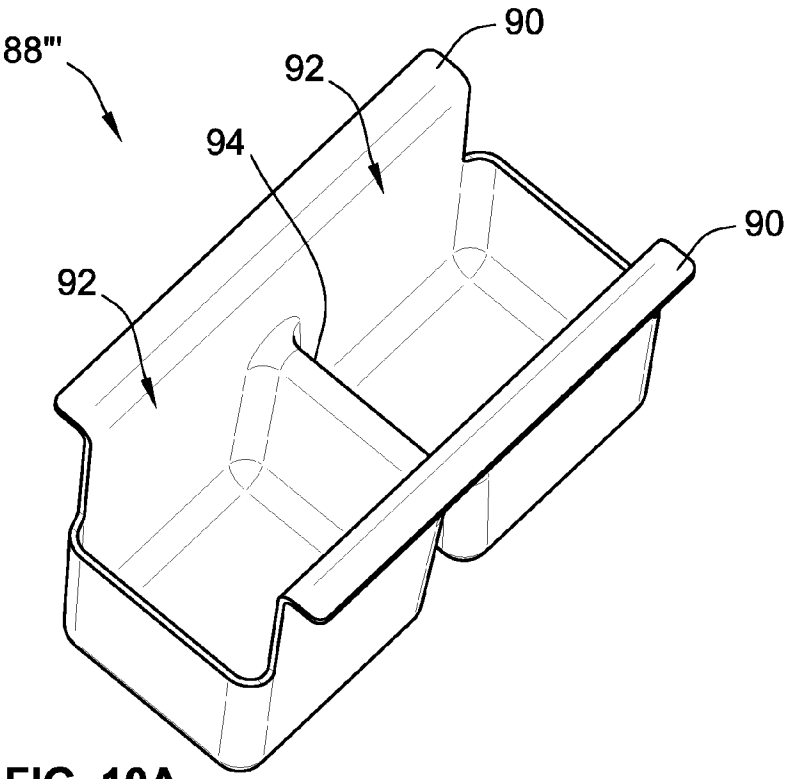
Figure 10D:
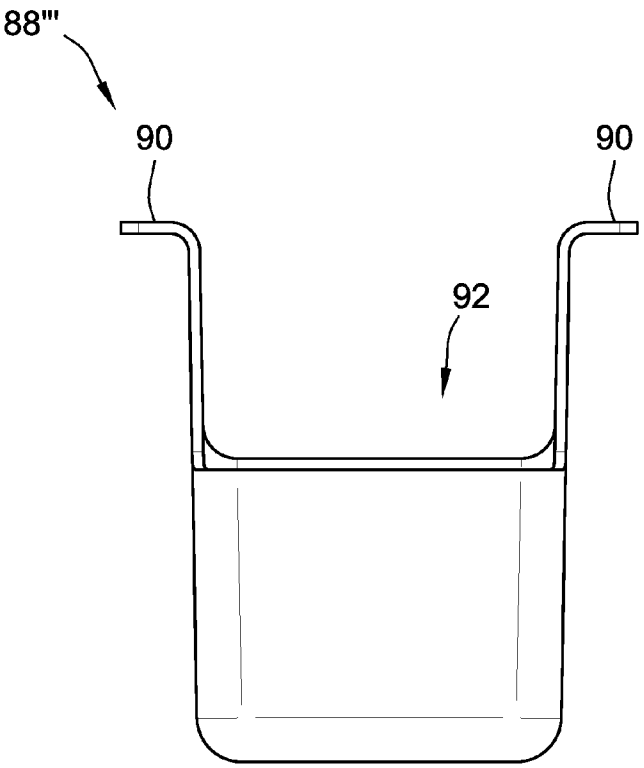
Figure 10C:
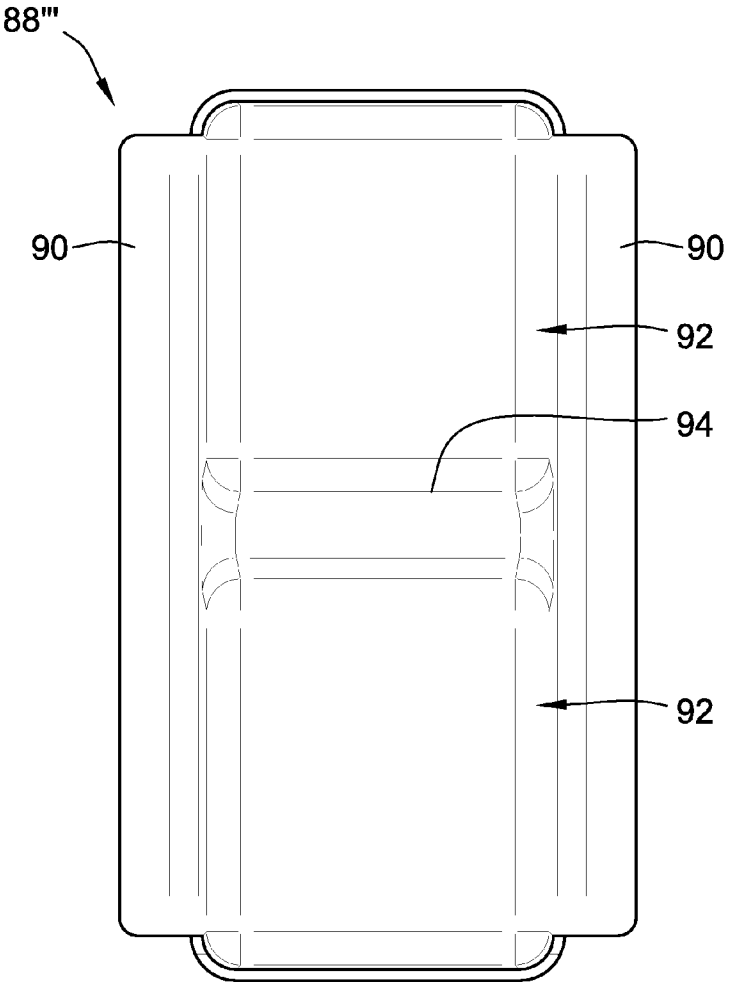
Figure 10E:
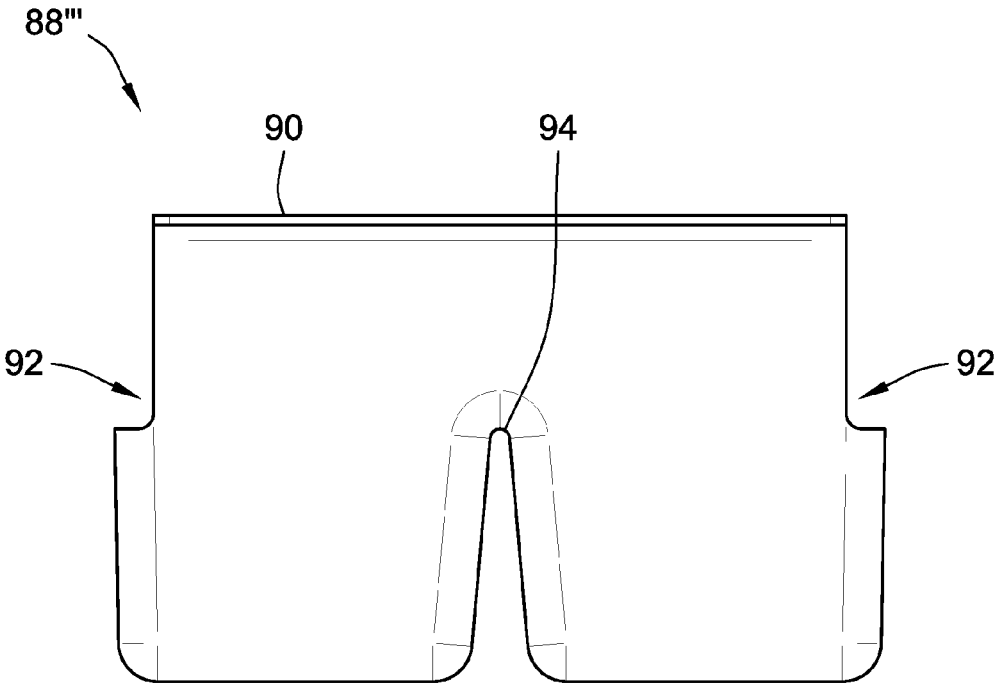
Figure 10F:
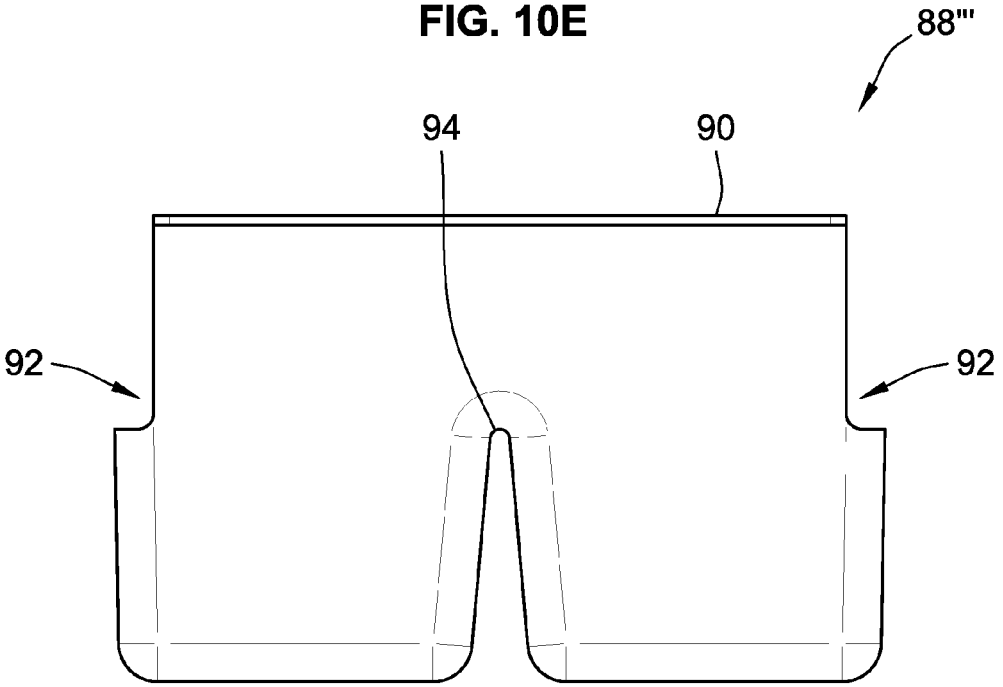
Figure 10H:
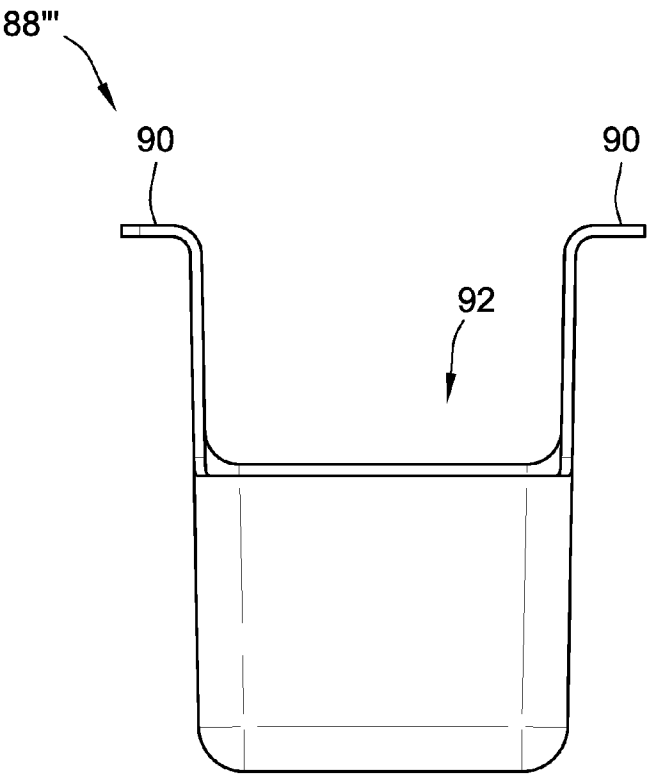
Figure 10G:
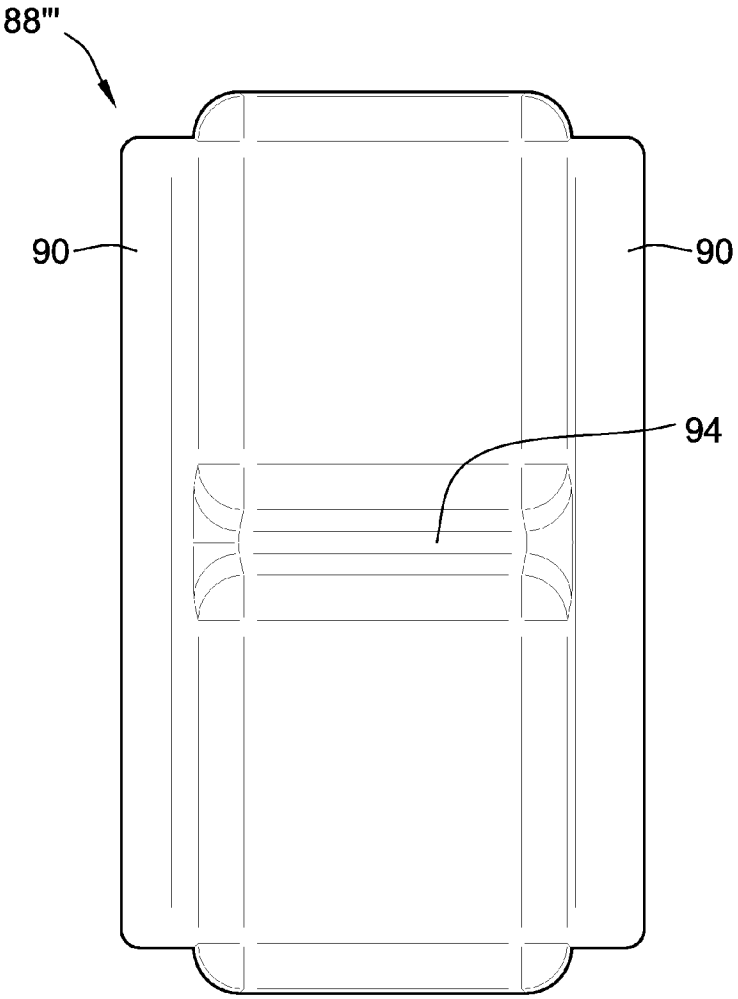

As can be seen in FIG. 7B, the sliding tray 88''' occupies approximately one-third of the opening 36; however, in other embodiments the sliding tray 88''' can occupy from one-fifth to one-half the opening 36. As can be seen in FIG. 10A, the sliding tray 88''' is divided into two compartments 92 using an integrally molded divider 94. Additionally, the ends of the sliding tray 88''' are depicted as being flat, i.e., they do not match the shape of the opening 36. This allows multiple sliding trays 88''' to be inserted in the opening 36 and abutted against one another. However, one or both ends of the sliding tray 88''' could match the shape of the opening 36. Also as depicted in FIG. 10A, the end walls of the sliding tray 88''' do not extend to the full height defined by the sidewalls of the sliding tray 88'''. This allows large or bulky items to be stored within the tray without the operator attempting to fit such an item in one of the compartments. It also allows a large or bulky item to be stored across multiple sliding trays 88''' if multiple sliding trays 88''' are used. Nevertheless, the end walls in other embodiments extend to the full height defined by the sidewalls. Like the half tray 88'', the sliding tray 88''' provides access to the air volume 28 below the deck 26 without removal of the sliding tray 88'''. As depicted in FIG. 7B, the sliding tray 88''' can be slid within the opening 34 as designated by arrow 96.

Figure 11:
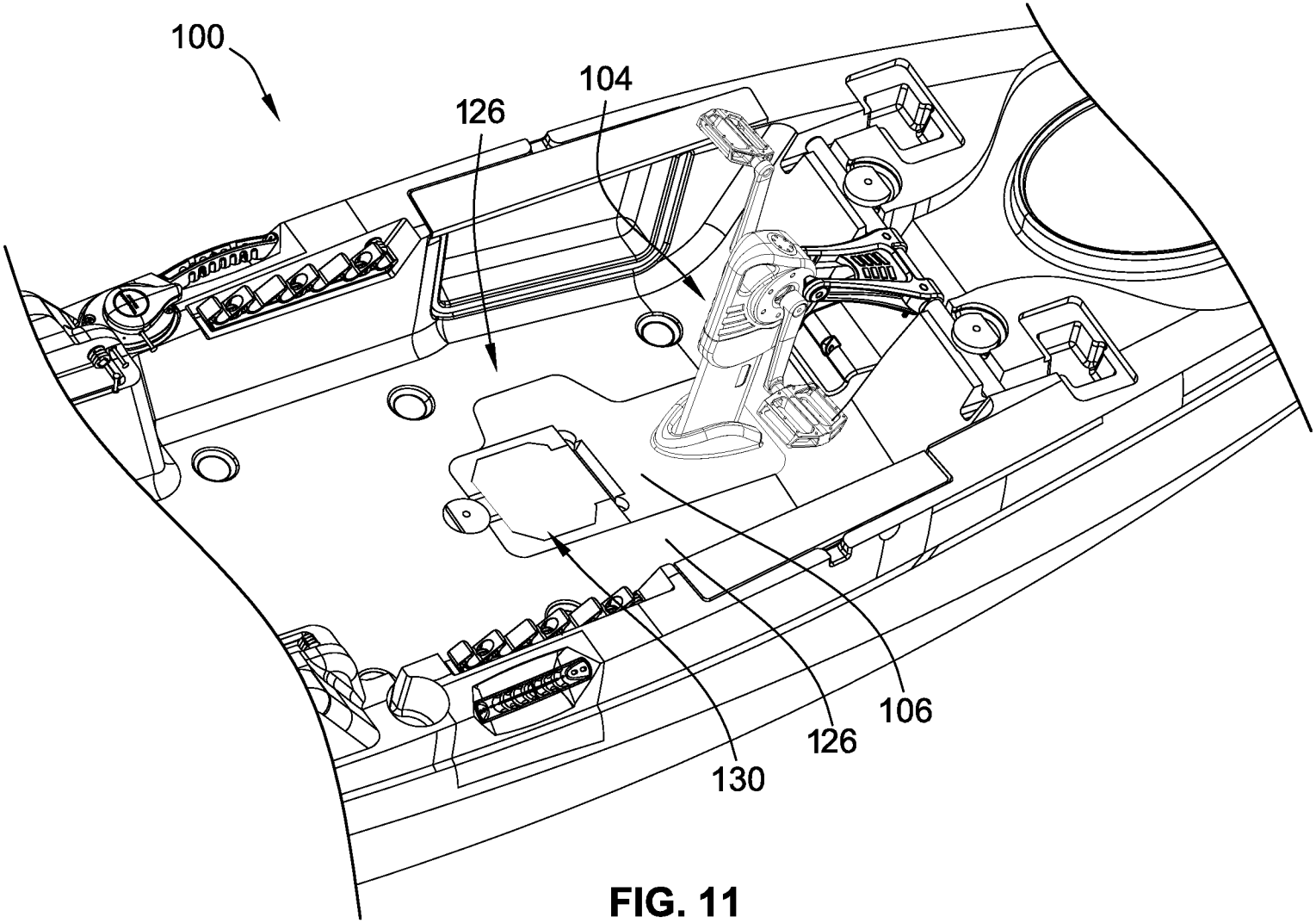
FIG. 11 depicts a kayak with a pedal drive system in which the pedal drive system has a storage compartment according to an exemplary embodiment.
Figure 12:
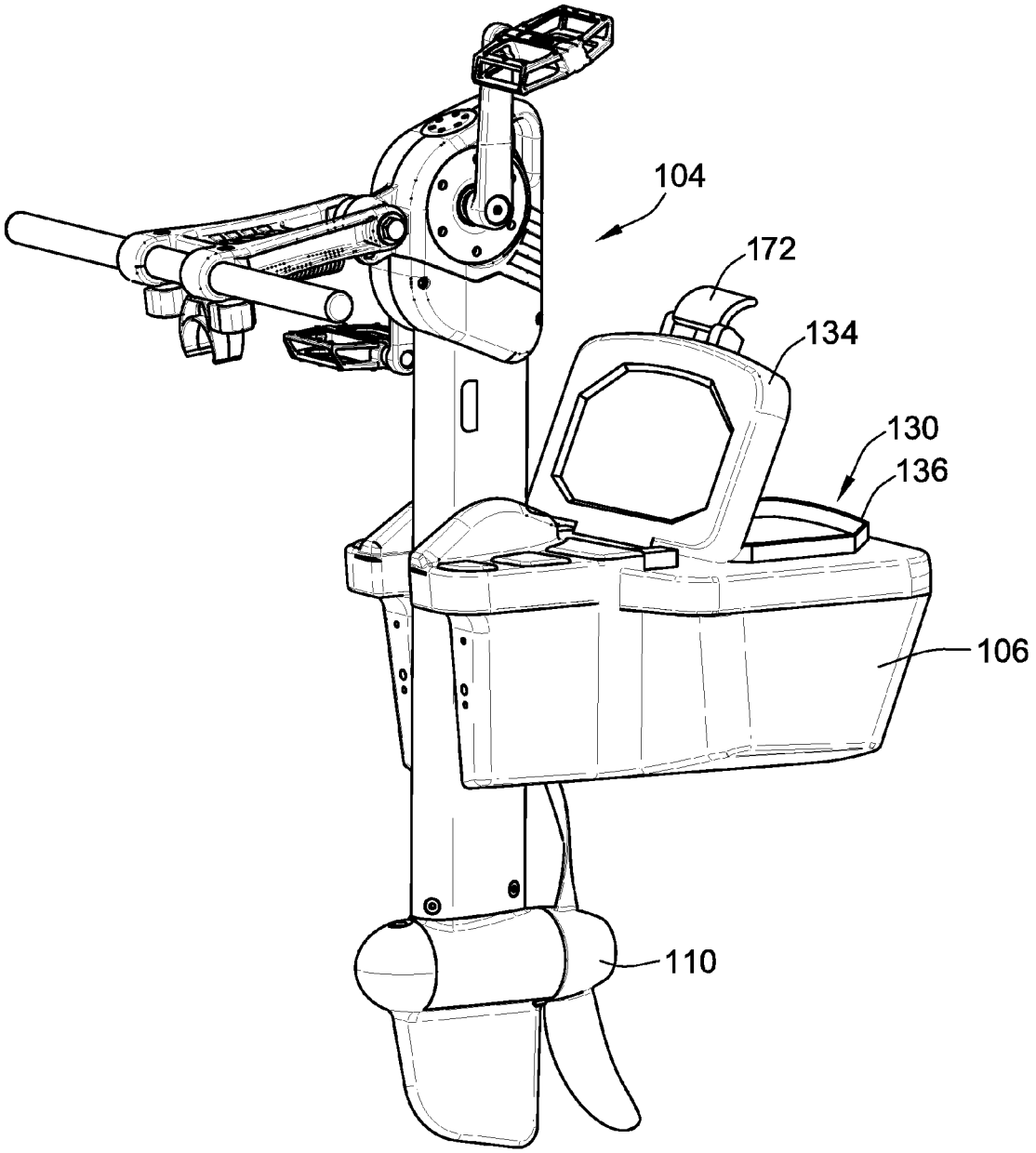
FIG. 12 depicts the pedal drive system of FIG. 11 with the storage compartment in the open configuration according to an exemplary embodiment.
Figure 13A:
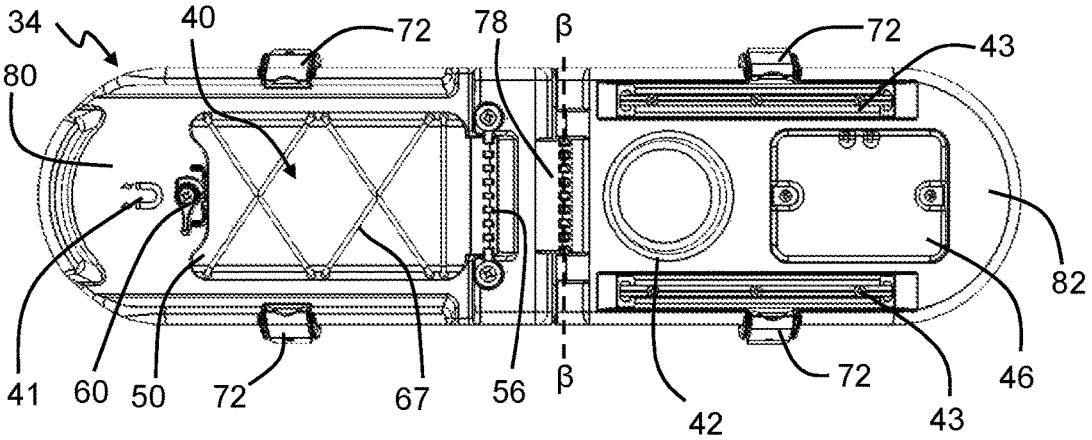
FIGS. 13A-13H depict another configuration of a center hinge cover according to an exemplary embodiment.
Figure 13B:
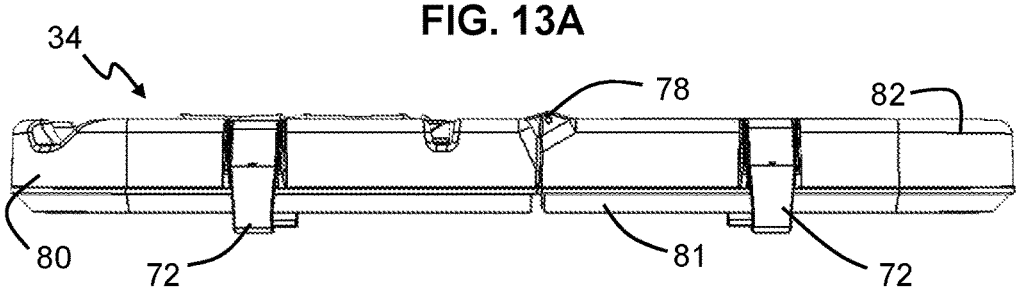
Figure 13C:
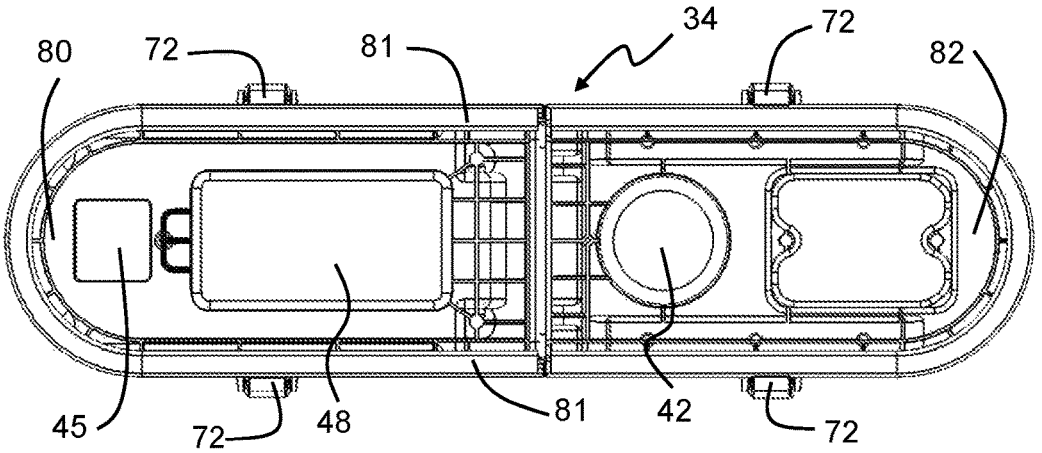
Figure 13D:
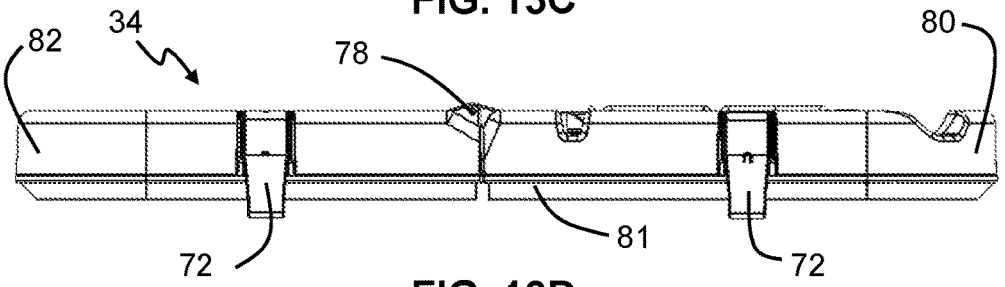
Figure 13E:
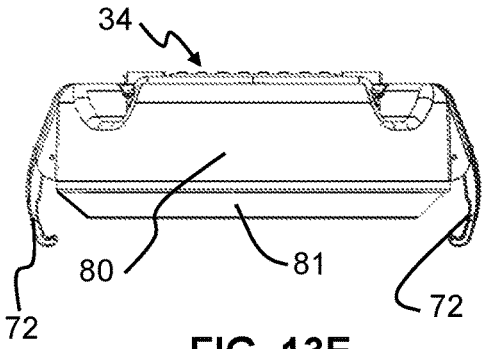
Figure 13F:
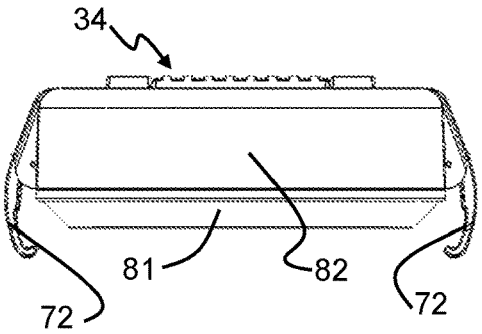
Figure 13G:
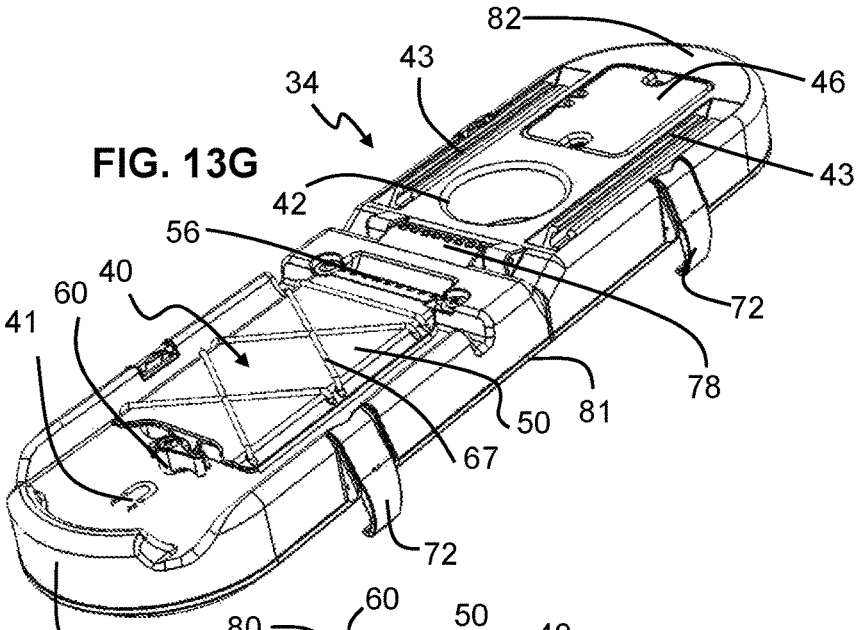
Figure 13H:
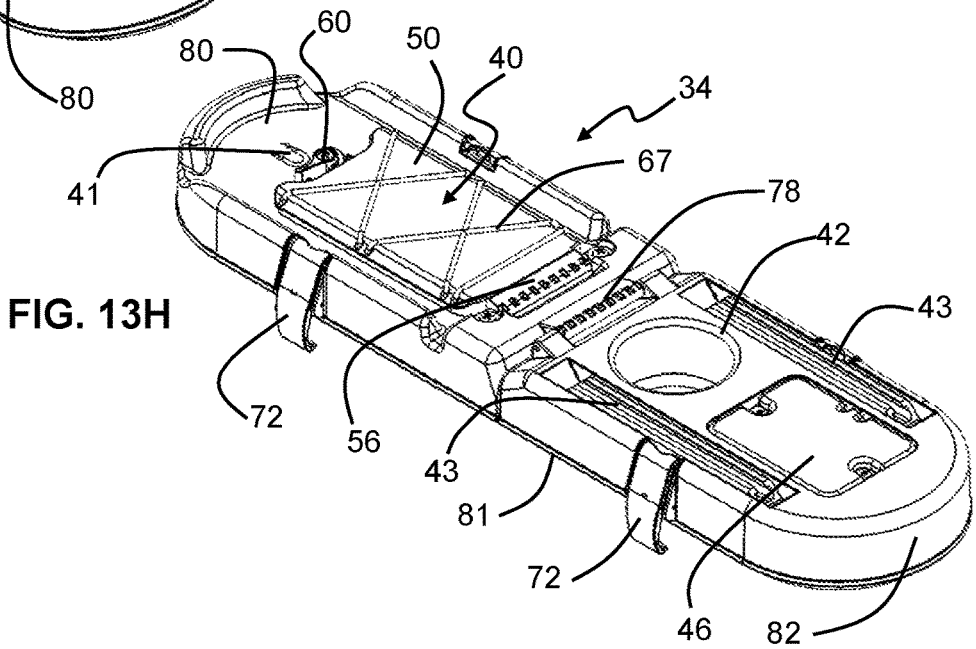

In another embodiment depicted in FIGS. 11-12, a kayak 100 is provided with a storage compartment 130 on a console member 106 of a pedal drive system 104. The pedal drive system 104 is preferably the pedal drive system disclosed in U.S. patent application Ser. No. 14/727,501, filed on Jun. 1, 2015 and having a common assignee with the present application. The entirety of the teachings of U.S. application Ser. No. 14/727,501 is incorporated herein by reference. As shown in FIG. 12, the pedal drive system 104 includes a propeller 110 that is driven by the pedals of the pedal drive system 104 to move the kayak 100 across a body of water. The pedal drive system 104 is removable from the kayak 100 to facilitate carrying of the kayak 100 across land and/or to facilitate storage of the kayak 100 when it is out of water. Thus, as can be seen in FIG. 11, the pedal drive system 104 is reversibly mountable through a port in the deck 126 of the kayak 100. The console member 106 of the pedal drive system 104 plugs the port such that the kayak 100 does not take on water. Preferably, the console member 106 has a hollow interior such that the interior of the console member 106 is predominantly composed of an air cavity. In this way, the weight of the console member 106 is minimized while also providing a maximum amount of storage space within the console member.

Also as shown in FIG. 11, the console member 106 includes a storage compartment 130. Generally, the storage compartment 130 is comprised of an opening 136 (FIG. 12) in the console member 106 that provides access to the air cavity within the console member and a reversibly openable cover 134. In the embodiment shown in FIG. 12, the cover 134 is hinged to the console member 106 such that the cover 134 rotates about the hinge axis to open and close. Preferably, the storage compartment 130 is a dry storage compartment such that no water is able to enter the storage compartment 130 when the cover 134 is closed over the opening 136. In this way, a gasket may be provided in the cover 134 or around the opening 136 so as to prevent water from penetrating the storage compartment 130. The cover 134 is also provided with a clasping mechanism 172 (see FIG. 12) so as to secure the cover 134 against the opening 136.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A cover adapted to be reversibly attached over an opening of a storage compartment contained on a personal watercraft, the cover comprising:

a dry storage chamber; and at least one additional feature selected from the group consisting of a cup holder, an equipment rail, a surround tray, an accessory mounting plate, and a magnetic surface;

wherein the cover includes at least the additional feature of a magnetic surface, a cup holder, at least one equipment rail, and an accessory mounting plate; and wherein the cover further includes an elastic cord on a lid of the dry storage chamber and a plurality of latches configured to secure the cover to the opening of the storage compartment.

2. The cover of 1, wherein the cover includes at least the additional features of a magnetic surface, a cup holder, at least one equipment rail, and an accessory mounting plate.

3. The cover of claim 1, wherein the cover is divided into a first end and a second end by a center hinge, the center hinge being perpendicular to a longitudinal axis of the cover.

4. The cover of claim 3, wherein the center hinge is adapted to provide 180° of rotation of the first end relative to the second end.

5. The cover of claim 4, wherein the 180° of rotation allows a topmost surface of the first end to be brought into contact with a topmost surface of the second end.

6. The cover of claim 1, wherein a watertight membrane is provided around a at least a portion of the perimeter edge of the cover where the cover engages the opening of the storage compartment.

7. The cover of claim 1, wherein the dry storage chamber is a cellular device compartment.

8. The cover of claim 7, wherein the cellular device compartment has a clear lid such that contents of the cellular device compartment can be seen through the clear lid.

9. The cover of claim 1, wherein the cover is adapted to rotate about a hinge along a longitudinal edge of the opening.

10. A cover adapted to be reversibly attached over an opening of a storage compartment contained on a personal watercraft, the cover comprising:

a dry storage chamber, and at least one additional feature selected from the group consisting of a cup holder, an equipment rail, a surround tray, an accessory mounting plate, and a magnetic surface;

wherein the cover is divided into a first end and a second end by a center hinge, the center hinge being perpendicular to a longitudinal axis of the cover; and wherein the first end and the second end have a region of overlap when the first end and second end are in a generally planar configuration and wherein the region of overlap is provided with a gasket seal adapted to prevent water from entering the storage compartment through the region of overlap.

* * * * *